US008466845B2

(12) United States Patent
Elsallal et al.

(10) Patent No.: US 8,466,845 B2
(45) Date of Patent: Jun. 18, 2013

(54) WIDE BANDWIDTH BALANCED ANTIPODAL TAPERED SLOT ANTENNA AND ARRAY INCLUDING A MAGNETIC SLOT

(75) Inventors: MohdWajih A. Elsallal, Cedar Rapids, IA (US); Daniel H. Schaubert, Amherst, MA (US)

(73) Assignee: University of Massachusetts, Boston, MA (US)

( * ) Notice: Subject to any disclaimer, the term of this patent is extended or adjusted under 35 U.S.C. 154(b) by 716 days.

(21) Appl. No.: 11/899,920

(22) Filed: Sep. 7, 2007

(65) Prior Publication Data

US 2008/0211726 A1 Sep. 4, 2008

Related U.S. Application Data

(60) Provisional application No. 60/843,630, filed on Sep. 11, 2006.

(51) Int. Cl.
*H01Q 13/10* (2006.01)

(52) U.S. Cl.
USPC ..... 343/770

(58) Field of Classification Search
USPC ..... 343/767, 770, 797, 795, 771
See application file for complete search history.

(56) References Cited

U.S. PATENT DOCUMENTS

| | | | | |
|---|---|---|---|---|
| 3,015,101 A | | 12/1961 | Turner et al. | |
| 5,557,291 A | * | 9/1996 | Chu et al. | 343/725 |
| 6,043,785 A | | 3/2000 | Marino | |
| 6,219,001 B1 | * | 4/2001 | Sugawara et al. | 343/767 |
| 6,317,094 B1 | * | 11/2001 | Wu et al. | 343/767 |
| 6,552,691 B2 | * | 4/2003 | Mohuchy et al. | 343/770 |
| 7,088,300 B2 | | 8/2006 | Fisher | |
| 2005/0012672 A1 | | 1/2005 | Fisher | |

OTHER PUBLICATIONS

Gregory J. Wunsch and Daniel H. Schaubert, "Full and Partial Crosswalls Between Unit Cells of Endfire Slotline Arrays," IEEE Transactions on Antennas and Propagation, vol. 48, No. 6, Jun. 2000, pp. 981-986.*

Gregory J. Wunsch and Daniel H. Schaubert, "Effects on Scan Blindness of Full and Partial Crosswalls between Notch antenna array Unit Cells," in Dig. 1995 IEEE Antennas Propagat. Symp., Newport Beach, CA, 1995, pp. 1818-1821.*

J.D.S. Langley and P.S. Hall and P. Newham, "Balanced Antipodal Vivaldi Antenna for Wide Bandwidth Phased Arrays," IEEE Proc.-Microw. Antennas Propag., vol. 143, No. 2, Apr. 1996, pp. 97-102.*

(Continued)

*Primary Examiner* — Robert Karacsony
(74) *Attorney, Agent, or Firm* — Lando & Anastasi, LLP

(57) ABSTRACT

A balanced, antipodal tapered slot antenna includes one or more antenna elements or unit cells having metallic cross walls that are located in spaces between the adjacent elements of the antenna. The elements can include vias interconnecting metallic conductors of the elements and one or more magnetic slots in the metallic conductors. A plurality of the antenna elements or unit cells can be arranged in an antenna array that has a mirrored configuration with adjacent intermediate neighboring elements of the antenna array mirrored one-dimensionally with elements reversed along the E-plane, or doubly-mirrored, two-dimensionally, in the E-plane and the H-plane by reversing the orientation of alternate elements. Metallic cross walls and metallic rods are disposed in a non-electrically contacting relationship with adjacent antenna elements. The substrate of the antenna includes dielectric material located at the aperture of the antenna element.

27 Claims, 16 Drawing Sheets

OTHER PUBLICATIONS

Bayard et al., "E-Plane Scan Performance of Infinite Arrays of Dipoles Printed on Protruding Dielectric Substrates: Coplanar Feed Line and E-Plane Metallic Wall Effects," IEEE Transactions on Antennas and Propagation, vol. 41, No. 6, Jun. 1993, pp. 837-841.

Elsallal et al., "On the Performance Trade-Offs Associated with Modular Element of Single-and Dual-Polarized DmBAVA," date unkown, 34 pages.

Elsallal et al., "Parameter Study of a Single Isolated Element and Infinite Arrays of Balanced Antipodal Vivaldi Antennas," date unkown, 25 pages.

Elsallal et al., "Reduced-Height Array of Balanced Antipodal Vivaldi Antennas (BAVA) with Greater Than Octave Bandwidth," date unknown, 17 pages.

Holter et al., "Elimination of Impedance Anomalies in Single-and Dual-Polarized Endfire Tapered Slot Phased Arrays," IEE Transactions on Antennas and Propagation, vol. 48, No. 1, Jan. 2000, pp. 122-124.

Kim et al., "Ultra Wideband 8 to 40 GHz Beam Scanning Phased Array Using Antipodal Exponentialy-Tapered Slot Antennas," IEE MIT-S Digest, 2004, pp. 1757-1760.

Langley et al., "Balanced Antipodal Vivaldi Antenna for Wide Bandwidtch Phased Arrays," IEEE Proc.-Microw. Antennas Propag., vol. 143, No. 2, Apr. 1996, pp. 97-102.

Maloratsky, Leo G., "Reviewing the Basics of Microstrip Lines," Microwaves & RF, Mar. 2009, pp. 79-88.

Marklein, Eric R., "Parameter Study of Ultra Wideband Fatloop Antenna", May 2005, 35 pages.

Wunsch et al., "Effects on Scan Blindness of Full and Partial Crosswalls between Notch Antenna Array Unit Cells," IEEE 1995, pp. 1818-1821.

Wunsch et al., "Full and Partial Crosswalls Between Unit Cells of Endfire Slotline Arrays," IEEE Transactions on Antennas and Propagation, vol. 28, No. 6, Jun. 2000, pp. 981-986.

* cited by examiner

SUBSTRATE THICKNESS = t

FIG. 9
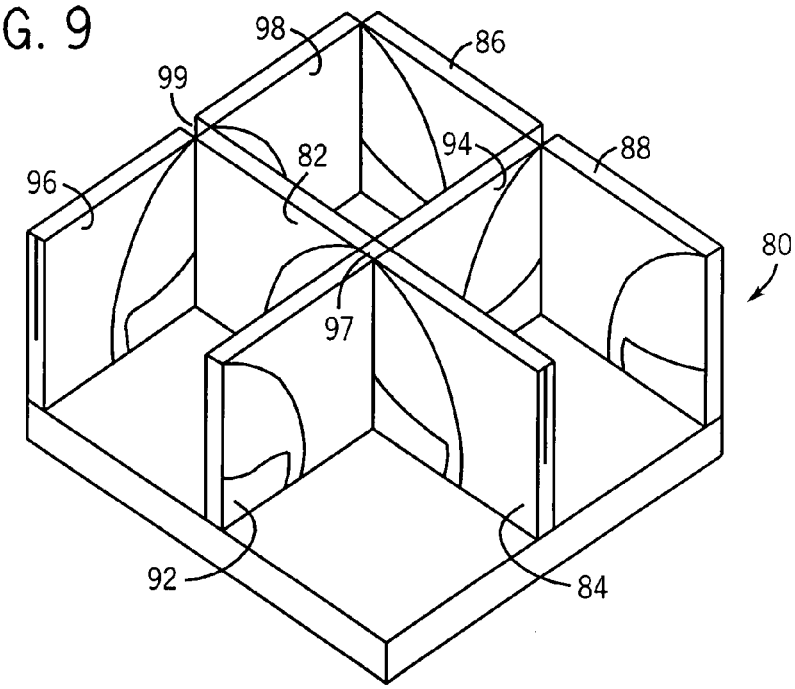
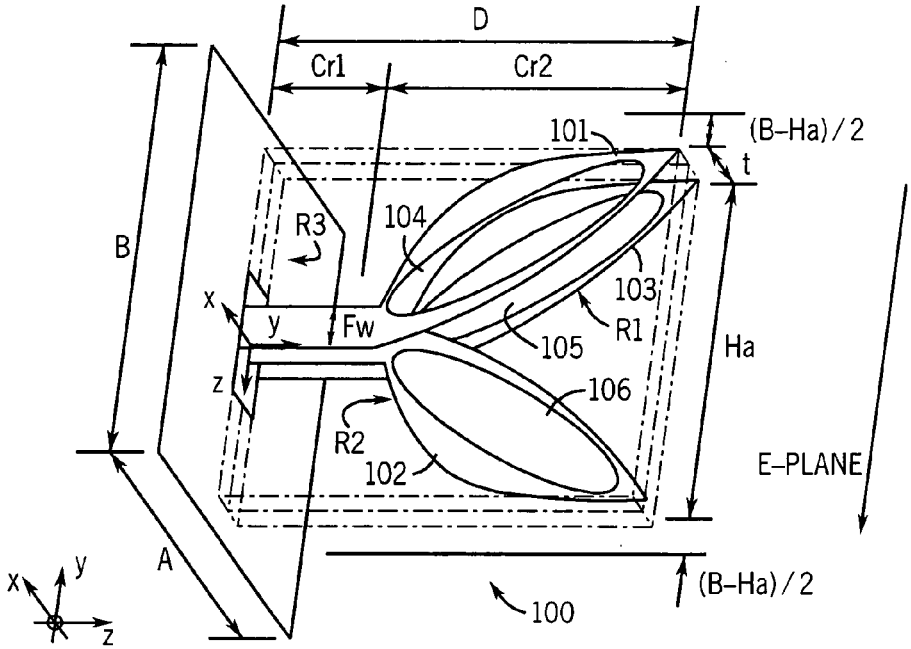
FIG. 10

—— BS,$Fw_1$=$Fw_2$ -·-·- E45°,$Fw_1$=$Fw_2$ -··-·· BS,$Fw_1$<$Fw_2$ ---- E45°,$Fw_1$<$Fw_2$

—— BS,$Fw_1$=$Fw_2$ -·-·- H45°,$Fw_1$=$Fw_2$ -··-·· BS,$Fw_1$<$Fw_2$ ---- H45°,$Fw_1$<$Fw_2$

WIDE BANDWIDTH BALANCED ANTIPODAL TAPERED SLOT ANTENNA AND ARRAY INCLUDING A MAGNETIC SLOT

CROSS-REFERENCE TO RELATED APPLICATION

This application claims priority benefit of provisional application Ser. No. 60/843,630, which was filed on Sep. 11, 2006, which application is hereby incorporated herein by reference.

BACKGROUND OF THE INVENTION

Field of the Invention

The present invention relates to improvements in antennas, and more particularly, to wide bandwidth antennas of the Vivaldi, notch or tapered slot antenna family.

As electronic systems are gaining the capability to operate over wide bandwidths and as military and civilian operations have become more dependent on radio frequency (RF), millimeter and microwave frequencies for communication and sensing, the demand for wide and multi-band antennas has increased. The military is becoming more dependent on wide-scan, multi-beam, interlink-satellites and ad-hoc networking for high quality voice communications and high speed real-time mobile-multimedia applications. The avionics industry is demanding more internet access in the sky. Furthermore, high performance antennas often require electronic beam steering, which necessitates phased arrays.

The Vivaldi antenna, first appearing in 1974, has been the initiative for the research towards wide bandwidth single element radiators. Several generations of this antenna have been developed, such as the Linear Tapered Slot Antenna (LTSA), Constant Width Slot Antenna (CWSA), Broken Linear Tapered Slot Antenna (BLTSA). See, for example, K. S. Yngvesson et al, "Endfire Tapered Slot Antenna on Dielectric Substrates," IEEE Trans. on Antennas and Propagation, Vol. 33, No. 12, December 1985, pp. 1392-1400. The Bunny Air Antenna has also shown appreciable bandwidth. See, for example, J. J. Lee et al, "Wide Band Bunny-Ear Radiating Element," IEEE Antenna and Propagation Society International Symposium, 1993, pp. 1604-1607. For multi-band, widescan and dual polarized phased array antenna systems, exponentially flared versions of the stripline-fed notch have been developed and are the dominant solution for multioctave scanning arrays. See L. R. Lewis, M. Fasset and J. Hunt, "A Broadband Stripline Array Element," Digest of 1974 IEEE Ant and Propagat. Symp., pp. 335-337. 1974. The design of these antennas has been aided by modern computational tools, which have enabled parameter studies that elucidate performance and that lead to design curves as reported by T. H. Chio and D. H. Schaubert, "Parameter Study and Design of Wide-Band Widescan Dual-Polarized Tapered Slot Antenna Arrays," IEEE Trans. on Antennas and Propagation, Vol. 48, No. 6, June 2000, pp. 879-886.

The Antipodal Vivaldi Antenna (AVA) was introduced by E. Gazit in 1988. The AVA utilizes a tapered transition from microstrip to antipodal slot line. However, the antipodal conductors cause the electric field vector to skew, producing a cross-polarized field, even in the boresight direction, that is not constant over the operating bandwidth.

The balanced antipodal Vivaldi antenna (BAVA), was developed by J. D. S. Langley, P. S. Hall and P. Newham in 1996 (Langley et al., "Balanced Antipodal Vivaldi Antenna for Wide Bandwidth Phased Arrays," IEE Proceeding of Microwave and Antenna Propagations, Vol. 143, No. 2, April 1996, pp. 97-102). The Balanced Antipodal Vivaldi Antenna eliminates the boresight cross-polarization by using a triplate structure. The BAVA uses an exponential flare into a three-conductor slotline to slowly rotate the opposing electric field vectors of the triplate (stripline) mode into substantially parallel vectors for which the cross-polarized portions cancel in the boresight direction. However, the work done by P. S. Hall on the BAVA is limited to single elements and small linear arrays. M. W. Elsallal and D. H. Schaubert published results of initial studies which intended to better understand the performance of these antennas in large array environment (M. W. Elsallal and D. H. Schaubert, "Parameter Study of Single Isolated Element and Infinite Arrays of Balanced Antipodal Vivaldi Antennas," 2004 Antenna Applications Symposium, Allerton Park, Monticello, Ill., pp. 45-69, 15-17 Sep. 2004). These numerical simulations have identified small operating bands at boresight bounded by troublesome impedance anomalies.

In the past, parameter studies of infinite arrays of balanced antipodal Vivaldi antennas (BAVAs) have identified small operating bands bounded by troublesome impedance anomalies. However, these studies did not identify a definitive relationship between those anomalies and the antenna design parameters.

In a paper entitled "Ultra Wideband 8 to 40 GHz Beam Scanning Phased Array Using Antipodal Exponentially-Tapered Slot Antennas," IEEE MTT-S International Symposium, Vol. 3, pps. 1757-1760, June 2004, S. Kim and K. Chang, describe a subarray that includes a mirrored H-plane linear array of the antipodal Vivaldi antennas (AVAs) introduced by E. Gazit (E. Gazit, "Improved Design of the Vivaldi Antenna," IEE Proceedings, Vol. 135, No. 2, April 1998, pp. 89-92) to overcome the polarization slant inherent in the AVA. S. Kim and K. Chang show results for a four-element, linear array that appears to perform well over a bandwidth of 5:1 and for scan angles up to 30°. However, numerical simulations of an extension of their subarray into an infinite planar array exhibit severe impedance anomalies similar to those documented by M. W. Elsallal and D. H. Schaubert, in "Parameter Study of Single Isolated Element and Infinite Arrays of Balanced Antipodal Vivaldi Antennas," 2004 Antenna Applications Symposium, Allerton Park, Monticello, Ill., pp. 45-69, 15-17 Sep. 2004.

REFERENCES

Background information, including references cited in this application, together with other aspects of the prior art, including those teachings useful in light of the present invention, are disclosed more fully and better understood in light of the following references, each of which is incorporated herein in its entirety.

1. P. J. Gibson, "The Vivaldi Aerial," Proc. 9th European Microwave Conference, 1979, pp. 101-105.
2. K. S. Yngvesson et al, "Endfire Tapered Slot Antenna on Dielectric Substrates," IEEE Trans. on Antennas and Propagation, Vol. 33, No. 12, December 1985, pp. 1392-1400.
3. J. J. Lee et al, "Wide Band Bunny-Ear Radiating Element," IEEE Antenna and Propagation Society International Symposium, 1993, pp. 1604-1607.
4. L. R. Lewis, M. Fasset and J. Hunt, "A Broadband Stripline Array Element," Digest of 1974 IEEE Ant and Propagat. Symp., pp. 335-337. 1974.
5. T. H. Chio and D. H. Schaubert, "Parameter Study and Design of Wide-Band Widescan Dual-Polarized Tapered Slot Antenna Arrays," IEEE Trans. on Antennas and Propagation, Vol. 48, No. 6, June 2000, pp. 879-886.

6. E. Gazit, "Improved Design of the Vivaldi Antenna," IEE Proceedings, Vol. 135, No. 2 April 1998. pp. 89-92.
7. J. D. Langely et al, "Balanced Antipodal Vivaldi Antenna for Wide Bandwidth Phased Arrays," IEE Proceeding of Microwave and Antenna Propagations, Vol. 143, No. 2 April 1996, pp. 97-102.
8. M. W. Elsallal and D. H. Schaubert, "Parameter Study of Single Isolated Element and Infinite Arrays of Balanced Antipodal Vivaldi Antennas," 2004 Antenna Applications Symposium, Allerton Park, Monticello, Ill., pp. 45-69, 15-17 Sep. 2004.
9. J, A, Noronha, T. Bielawa, C. Anderson, D. Sweelney, S. Licucl and W. Davis, "Designing Antennas For UWB Systems," Microwaves and RF Journal, June 2003, pp. 53-61.
10. M. W. Elsallal and D. H. Schaubert, "Reduced-Height Array of Balanced Antipodal Vivaldi Antennas (BAVA) with Greater than Octave Bandwidth," Antenna Applications Symposium, Allerton Park, Monticello, Ill., pp. 226-242, 21-23 Sep. 2005.
11. H. Holter, Yan-Huat Chio and D. H. Schaubert, "Elimination of Impedance Anomalies in Single- and Dual-Polarized Endfire Tapered Slot Phased Arrays," IEEE Trans. Antenna and Propagation. Vol. AP-48, No. 1, pp 122-123, January 2000
12. J.-P R. Bayard, D. H. Schaubert and M. E. Cooley, "E-plane Scan Performance of Infinite Arrays of Dipole Printed on Protruding Dielectric Substrates: Co-planar Feed Line and E-Plane Metallic Walls Effect," IEEE Trans. Antenna and Propagation. Vol. AP-41, No. 6, pp 837-841, June 1993.
13. M. W. Elsallal and D. H. Schaubert, "Reduced-Height, Wide-Bandwidth Dual-Polarized Array of Doubly-Mirrored Balanced Antipodal Vivaldi Antennas (DP-Dm-BAVA)," Poster Session, Antenna Review Day, University of Massachusetts-Amherst, 1 Dec. 2005.
14. S. Kim and K. Chang, "Ultra Wideband 8 to 40 GHz Beam Scanning Phased Array Using Antipodal Exponentially-Tapered Slot Antennas," IEEE MTT-S International Symposium, Vol. 3, pp 1757-1760, June 2004.
15. M. W. Elsallal and D. H. Schaubert, "Electronically Scanned Arrays of Dual-Polarized, Doubly-Mirrored Balanced Antipodal Vivaldi (DmBAVA) Based on Modular of Elements," IEEE Antenna and Propagation Symposium, pp. 887-889, 9-12 Jun. 2006. Albuquerque, N. Mex.

SUMMARY OF THE INVENTION

The present invention provides a balanced antipodal tapered slot antenna comprising: a plurality of unit cells arranged in an antenna array, each of the unit cells including at least one antenna element, the antenna element including first and second substrates of a dielectric material; first, second and third metallic conductors, the first and third conductors being disposed on the first and second substrates, defining a balanced ground plane for the antenna element in a feed region for the antenna element; the second metallic conductor disposed on one of the substrates defining a tapered transmission line in the feed region of the antenna element; at least one metallic cross wall located between the one antenna element and a further antenna element of the antenna array that is located adjacent the one antenna element; and a feed line coupled to the tapered transmission line for applying excitation signals to the antenna array from driving circuitry.

The invention further provides an antipodal tapered slot antenna comprising: a plurality of unit cells arranged in an antenna array, each of the unit cells including at least one antenna element, the antenna element including a first substrate of a dielectric material having first and second sides, a first metallic conductor on the first side of the substrate, a second metallic conductor on the second side of the substrate; a second substrate of a dielectric material; at least one metallic cross wall located between the one antenna element and a further antenna element located adjacent the one antenna element; and a feed line coupled to the tapered transmission line for applying excitation signals to the antenna array from driving circuitry.

Further in accordance with the invention, there is provided an antenna element or unit cell for a tapered slot antenna, or Vivaldi antenna, the antenna element or unit cell comprising: a first substrate of a dielectric material having first and second sides; a first metallic conductor on the first side of the substrate; a second metallic conductor on the second side of the substrate; a second substrate of a dielectric material; a third metallic conductor on a first side of the second substrate, the first and second substrates sandwiched together so that the first and third conductors are outermost and the first substrate is interposed between the first and second conductors and the second substrate is interposed between the third conductor and the second conductor; at least one metallic cross wall located between the first and second antenna elements; and a feed line coupled to the tapered transmission line for applying excitation signals to the antenna array from driving circuitry.

The antenna provided by the invention is a reduced-height, polarization-agile, wide bandwidth and modular tapered slot (or so called Vivaldi) antenna. In accordance with the invention, the geometry of elements of a conventional Vivaldi antenna are modified to improve the performance of the antenna, increasing the operating band of the antenna, lower the cross-polarization components, and eliminating or suppressing impedance anomalies. The modifications may be applied to any Vivaldi-like antenna structure, for example, the antipodal Vivaldi antenna (AVA) and the balanced antipodal Vivaldi antenna (BAVA). The modifications may also be applied to stripline-fed and microstripline-fed Vivaldi antenna, though the primary benefits are derived from modifications to the AVA and BAVA structures. It also can be applied to any other type of antenna that is has an antipodal symmetry, like double-dipole antenna, Bunny-ear antenna or bow-tie antennas. The modifications can include the addition of metallic cross walls in the air gaps between the elements of the antenna and placing vias in the substrates of the elements in the region near the tips of the antenna, to interconnect the fins located on the opposing outer surfaces of the element. The metallic cross walls located in the air gaps between elements suppress E-plane anomalies by shifting them out of the frequency band of interest. The vias located in the substrates of the elements suppress H-plane resonances.

Further in accordance with the invention, a mirroring technique is used in fabricating the antipodal and balanced antipodal Vivaldi antenna array. Utilizing the image theory, the adjacent intermediate neighboring elements of the antenna array are reversed along the E-plane creating a mirrored symmetry. To maintain the radiation pattern of the antenna array, adjacent elements are excited using differential excitation, with signals at phases 0° and 180° in the E-plane direction, resulting in parallel electric vectors at the element apertures. Further improvement of the mirrored antipodal and mirrored balanced antipodal Vivaldi antenna is achieved by the addition of metallic cross walls parallel to the H-plane of the antenna array.

Alternatively, improvement is obtained by introducing mirror symmetry in the H-plane direction in addition to the mirroring of elements in the E-plane, with differential excitation. In this doubly-mirrored configuration, alternate elements are reversed along the E-plane, creating a mirrored symmetry to alter the mutual coupling in the antenna array. Differential excitation of mirrored elements along the orthogonal planes of the array eliminates a further anomaly from the operating band and improves the scan-performance.

Further in accordance with the invention, the element can include one or more magnetic slots in the metallic fins and/or the feed section. The slots can be provided by selectively removing portions of the metallic fins of the elements. The presence of the magnetic slot produces a better impedance match in the operating bandwidth.

In accordance with a further modification, metallic rods can be inserted between the antipodal or the balanced antipodal Vivaldi antenna elements. The metallic rods are neither mechanically nor electrically connected to the neighboring elements in the antenna array. The presence of the metallic rods moves the low-frequency cut-off down, thereby widening the operational bandwidth.

To further improve impedance matching at the operational bandwidth, dielectric material can be located at the slot or aperture of the element. The dielectric material may be located to project beyond the footprint of the conventional element. Preferably, the additional dielectric material is provided by extending the substrate of the element. Alternatively, the additional dielectric material can be provided by adding a slab of dielectric material to the element. The presence of the dielectric improves the impedance matching in the operational bandwidth.

The antipodal and balanced antipodal Vivaldi antenna can be implemented as a single-polarized array or a dual-polarized array. In the single-polarized array, metallic cross walls parallel to the H plane of the array are inserted to improve the E-plane scan performance. Similar performance of the antipodal and balanced antipodal Vivaldi antenna can be obtained with or without using the mirroring technique by inserting metallic cross walls along the H-plane of the single-polarized Vivaldi antenna array.

The dual-polarized array does not require metallic cross walls. The addition of orthogonal elements to create a dual-polarized version of an single-polarized array produces similar effects to the metallic cross walls.

DESCRIPTION OF THE DRAWINGS

These and other advantages of the present invention are best understood with reference to the drawings, in which:

FIG. 9 is an isometric view illustrating a unit cell of a balanced antipodal Vivaldi antenna, including orthogonal elements substituted for the horizontal metallic plate of the unit cell shown in FIG. 8, realizing a dual-polarized array in accordance with the present invention;

FIG. 10 is an isometric view illustrating the structure of a balanced antipodal Vivaldi antenna element including a magnetic slot in accordance with the present invention;

DETAILED DESCRIPTION OF THE PREFERRED EMBODIMENT

Figure 1:
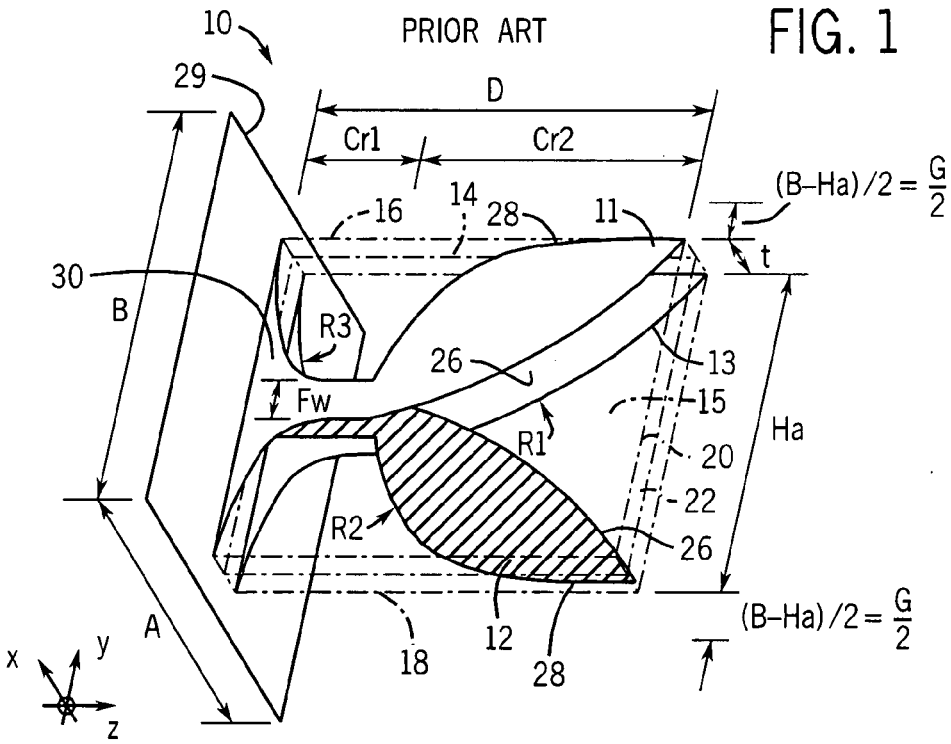
FIG. 1, which is labeled "Prior Art", is an isometric view illustrating the structure of a conventional balanced antipodal Vivaldi antenna element and unit cell in an infinite array environment.

With reference to the drawings, FIG. 1, which is labeled "Prior Art", illustrates the structure of a conventional balanced antipodal Vivaldi antenna element and unit cell 10 in an infinite array environment. The balanced antipodal Vivaldi antenna (BAVA) eliminates the boresight cross-polarization, the exists in the antipodal Vivaldi antenna (AVA), by using a triplate structure. The BAVA uses an exponential flare into a three conductor slotline to slowly rotate the opposing electric field vectors of the triplate (stripline) mode into substantially parallel vectors for which the cross-polarized portions cancel, in the boresight direction. In a BAVA, the center conductor represents a tapered stripline transmission line in the feed region. The upper and bottom conductors on the surfaces on the substrate form the ground plane of the stripline conductor in the feed region. The ground plane conductors are usually identical but not necessarily symmetric with the center conductor.

The descriptions of prior art and of the invention are presented with reference to the balanced antipodal Vivaldi antenna (BAVA). However, the invention can be applied equally to other antenna structures that have the nature of being antipodal symmetry, such as antipodal Vivaldi antennas, stripline-fed/microstripline-fed Vivaldi antennas, double-printed dipole, Bunny-ear antenna and bow-tie antennas. In accordance with the invention, modifications are made to the antenna geometry of the conventional balanced antipodal Vivaldi antenna element, hereinafter cBAVA element, providing a reduced-height, wide bandwidth array of balanced antipodal Vivaldi antenna elements. Prior to describing these modifications in detail, the following description of the structure of the cBAVA element is provided.

A balanced antipodal Vivaldi antenna element can be constructed from a first fin 11 on one side 14 of a first sheet 16 of dielectric substrate and a second fin 12 on the other side 18 of the first sheet 16. A second sheet 20 of dielectric substrate is provided with a third fin 13 on an outer side 22. The first sheet 16 and the second sheet 20 are sandwiched together so that the first and third fins 11,13 are outermost and so that dielectric substrate is interposed between the first fin 11 and the second fin 12 and between the third fin 13 and the second fin 12. The first and third fins 11,13 are arranged to flare in a first curved shape. The second fin 12 is arranged to flare in a second curved shape—the second curved shape being the mirror image of the first curved shape. When viewed at right angles to the plane of the substrates, the first and third fins 11,13 on one side and the second fin 12 on the other side form a flare-shaped slot 15. The flare arc length Cr2 represents the portion of the element depth D corresponding to the outer curves R1 and R2 of the fins, Cr1 is the length of the triline section 30, including curve R3, and Fw is the width of the stripline 30. FW is the width of the triline section between the backwall (or ground plane) 29 of the array and the metallic fins on the substrate. A feed line, such as a triline 30, provides a means to feed the antenna from standard stripline circuitry located behind the ground plane 29 and the triline 30. The elements of the unit cell 10 can be inserted in stand alone fashion perpendicular to the array's back wall 29 which acts as a ground plane. The elements can be integrated with T/R modular.

The design parameters of the cBAVA element are defined in FIG. 1. The shape of the metallic striplines/fins is composed of three tapered exponential curves controlled by three different opening rates R1, R2, and R3, defining an inner slotline arc 26, an outer slotline arc 28 and the slotline or Balun section 30, respectively. Each of the three curves is defined by the equation:

$$y = c_1 e^{Rz} + c_2 \quad (1)$$

where R can be R1, R2 or R3. Variables c1 and c2 are:

$$c_1 = \frac{y_2 - y_1}{e^{Rz_2} - e^{Rz_1}} \quad (2)$$

$$c_2 = \frac{y_1 e^{Rz_2} - y_2 e^{Rz_1}}{e^{Rz_2} - e^{Rz_1}} \quad (3)$$

where $(y_1,z_1)$ and $(y_2,z_2)$ are points at the start and end of the curve. The above equations are provided for exemplary purposes, but the curves may be made using a different set of equations and arcs or straight lines.

The antenna substrate is defined by the dielectric permittivity $\in_r$, loss tangent tan δ, and substrate thickness t. The substrate may be removed, resulting in a dielectric-less antenna, which is a limiting case of $\in_r=1$ and tan δ=0. The substrates 16,20 and metallic flares 26 of the antenna element 10 have an aperture height Ha, which is made to be smaller than the element height B.

The array parameters are E-plane spacing B and H-plane spacing A. Since the aperture height Ha is smaller than the E-plane spacing B, a gap G is introduced between any two adjoining elements along the E-plane, wherein the gap G is equal to at most the difference between E-plane spacing B and aperture height Ha, or $G \leqq B - Ha$. This means there is no electrical or mechanical contact between the adjoining BAVA elements. The gap G can be made slightly greater than the substrate thickness t to allow future transformation of this single-polarized array into a dual-polarized version as will be described.

Figure 3:
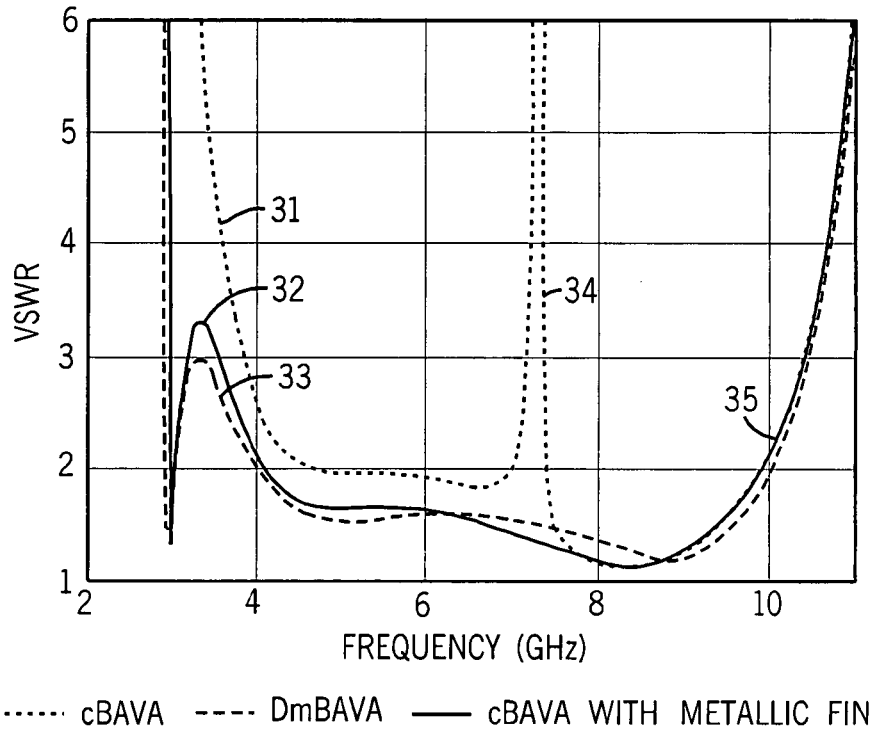
FIG. 3 is the VSWR for the conventional balanced antipodal Vivaldi antenna element of FIG. 1 without and with the metallic plate vs. the VSWR of the conventional balanced antipodal Vivaldi antenna element with the metallic plate and for a doubly-mirrored balanced antipodal Vivaldi antenna element.

The cBAVA element 10 can be a unit cell of a planar array, perhaps infinite in size. The performance of large arrays is characterized by two operating bands (approximately 1.4:1 bandwidth) bounded by strong anomalies. Referring to FIG. 3, curve 31 is a plot of voltage standing wave ratio (VSWR) as a function of frequency for the cBAVA element 10. A first anomaly 34 appears between about 7-8 GHz and a second anomaly 35 appears between about 10-11 GHz. It is understood that these frequencies are related to the size of the antenna and unit cell. Changing the antenna or unit cell dimensions by a scale factor changes the frequency characteristics by a similar scale factor in accordance with electromagnetic principles. Also, changing the shape of the fin or dielectric thickness, may introduce a new type of anomaly that could be overcome by one the techniques described in this patent application.

Figure 4:
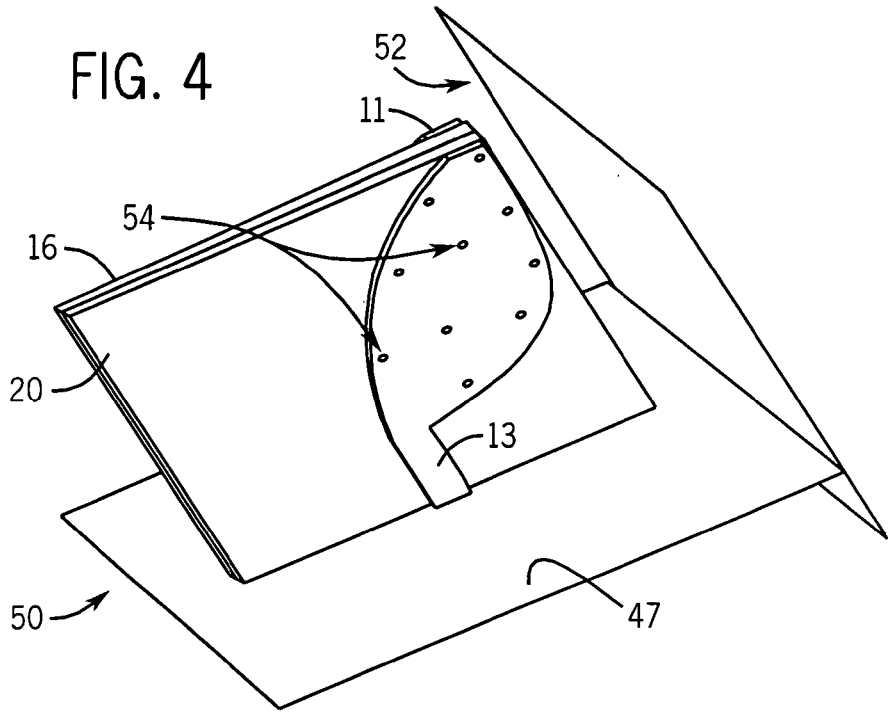
FIG. 4 is an isometric view illustrating a balanced antipodal Vivaldi antenna element including a metallic cross wall in accordance with the present invention.
Figure 15:
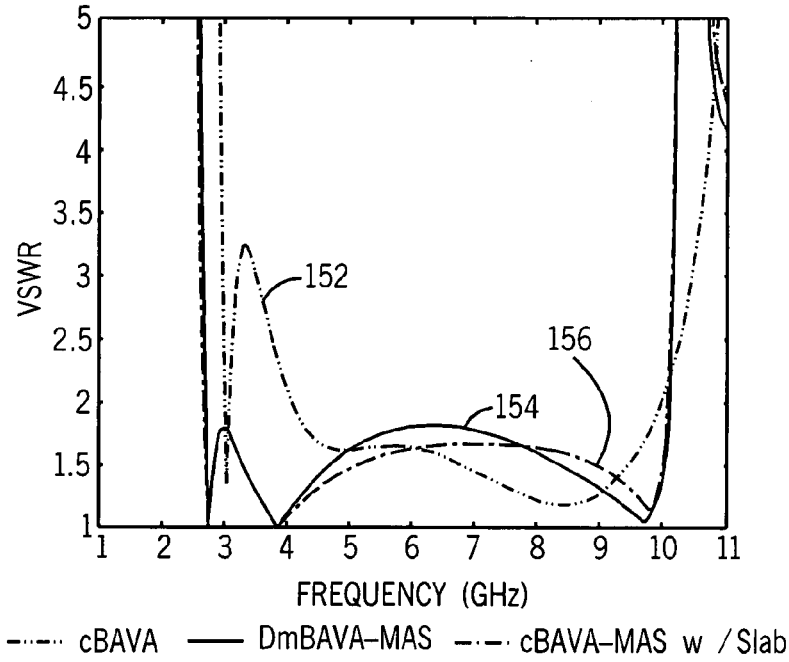
FIG. 15 is a plot of VSWR as a function of frequency, for the doubly-mirrored, balanced antipodal Vivaldi antenna with magnetic slots with and without the dielectric slab vs. the conventional doubly mirrored Balanced Antipodal Vivaldi Antenna or the conventional Balanced Antipodal Vivaldi with metallic crosswall.

Referring to FIGS. 1 and 4, in accordance with the invention, the geometry of the cBAVA element 10 is adjusted so that the first anomaly 34 is shifted out of the frequency band of interest, as shown by curve 156 in FIG. 15. The invention achieves this by making addition of metallic cross wall 52 in FIG. 4, doubly mirroring technique 70 in FIG. 8, metallic post 122 in FIG. 13, and/or magnetic slots 106 in FIG. 10. Referring also to FIG. 1, in accordance with the invention, the geometry of the cBAVA element 10 is adjusted so that the second anomaly 35 in FIG. 3 is shifted out of the frequency band of interest, as shown by curves 33 and 32 in FIG. 3 and curves 154 and 156 in FIG. 15. The invention achieves this by making the depth D of the radiating element as short as possible while maintaining good antenna performance in the frequency band of operation and over the scan range of interest.

Figure 8:
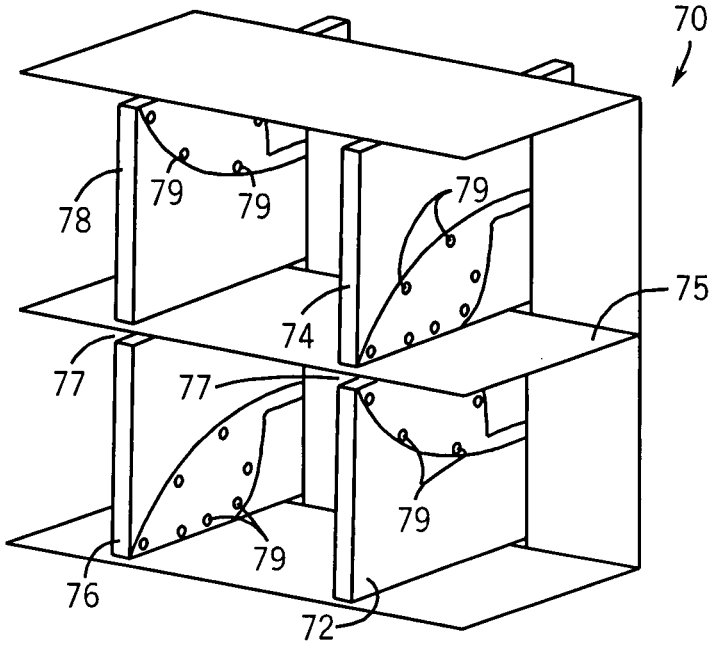
FIG. 8 is an isometric view illustrating a unit cell of a balanced antipodal Vivaldi antenna with adjoining elements doubly mirrored in accordance with the present invention.
Figure 18A:
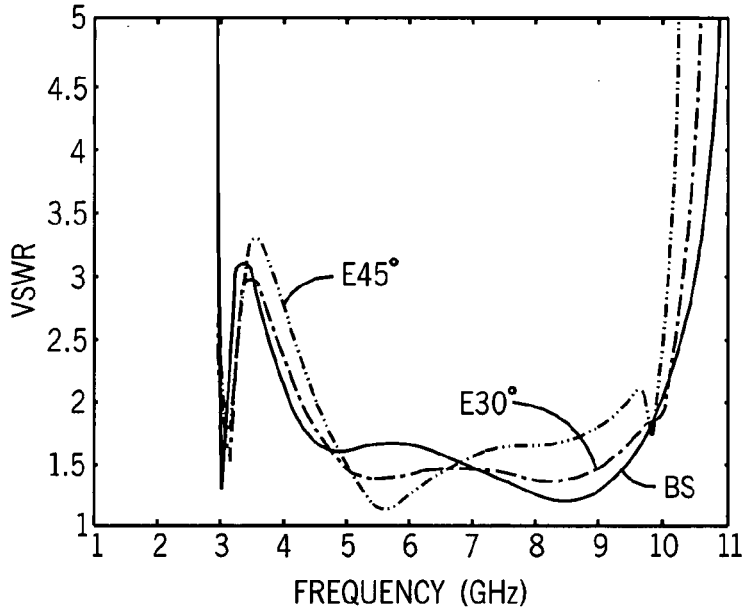
FIGS. 18A and 18B are plots of the E-plane VSWR and H-plane VSWR, respectively, as a function of frequency for the doubly-mirrored, balanced antipodal Vivaldi antenna of FIG. 8.
Figure 18B:
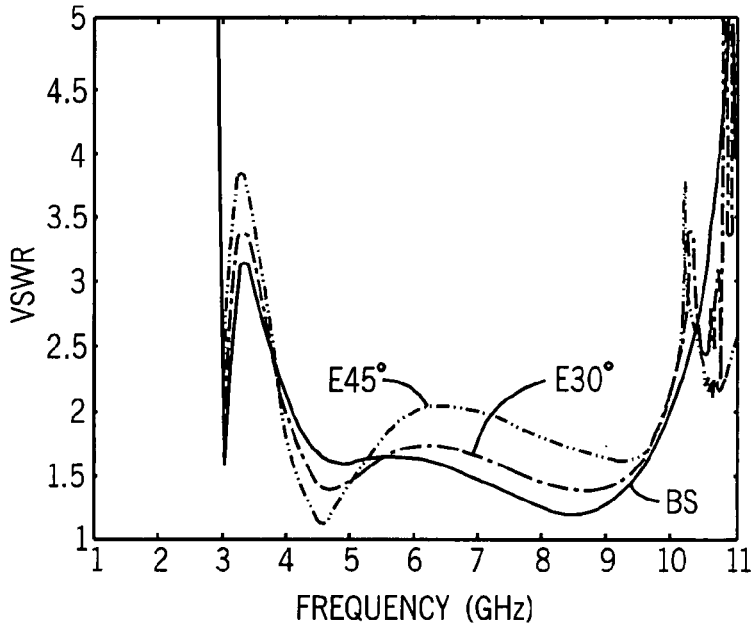

FIGS. 18A and 18B are plots of the E-plane VSWR and H-plane VSWR, respectively, as a function of frequency for the doubly-mirrored, balanced antipodal Vivaldi antenna of FIG. 8. Active VSWR is presented in FIGS. 18A and 18B for a reduced-height (where the depth of the array $D<0.56\lambda$ of the highest operating frequency), wide-band (2.4:1) and wide-scan angle (±45°) BAVA array. Additionally, a second iteration of the design cycle has led to a single polarized BAVA phased array with 3:1 bandwidth over a slightly reduced scan volume, ±30°. It should be understood that the $F_H/F_L$ ratio and maximum scan-volume ±θ degree can vary with changes of the design parameters, antenna size and the metallic fins' shapes.

Figure 2:
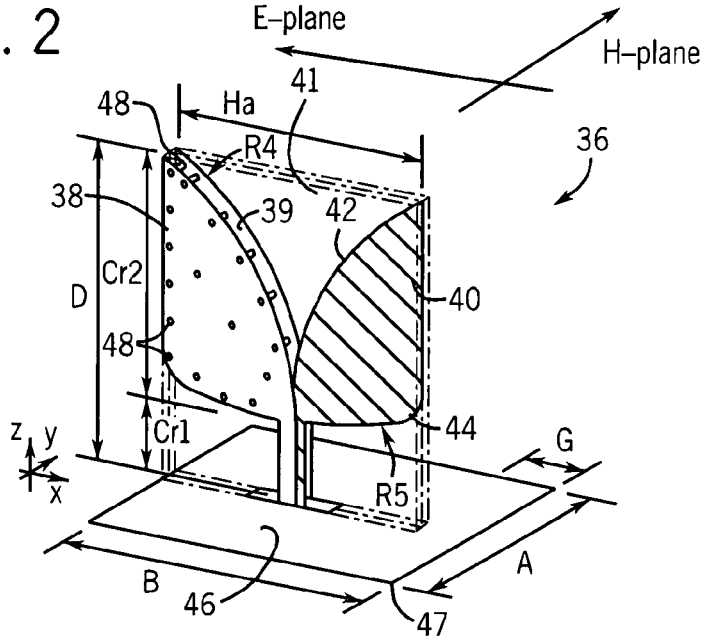
FIG. 2 is an isometric view illustrating an alternative structure of a balanced antipodal Vivaldi antenna element and unit cell in accordance with the present invention.

FIG. 2 is an isometric view illustrating an alternative structure of a balanced antipodal Vivaldi antenna isolated element and/or unit cell in accordance with the present invention. Referring to FIG. 2, alternatively, a BAVA element 36 can have the configuration shown in FIG. 2 wherein the fins 38, 39 and 40, on two substrates 41 as for cBAVA element 10, are composed of an inner tapered exponential curve 42 and an outer curve 44 controlled by two different opening rates R4 and R5, defining the inner slotline arc and the outer slotline arc. In this embodiment, by way of a non-limiting example, the triline 46 is substantially linear. It can vary to be very similar to the tapered triline section 30 in FIG. 1. Triline 46 provides a means to feed the antenna from standard stripline circuitry located behind the ground plane 47 and the triline 46. The design parameters and mounting arrangement of the BAVA element 36 can be similar to those defined for the cBAVA element 10 illustrated in FIG. 1.

To further improve the performance of the element 36 in an array, vias 48 interconnecting the two outer fins 38,39 of the BAVA element 36 are inserted into the substrates 41 of the BAVA element 36. The introduction of vias eliminates some resonances in single and dual polarized tapered slot phased arrays. The number and location of the vias can be different. The performance can be improved as a function of the number of vias per wavelength, the size of the vias, and their locations. By way of a non-limiting example, there may be at least seven vias per dielectric wavelength. Referring to FIG. 1, vias (not shown) can be inserted into the substrates 16 and 20 of the cBAVA element 10, interconnecting the two outer fins 11 and 13 of the cBAVA element 10 to improve performance of the element 10 in an array in the manner of the element 36 shown in FIG. 2.

With reference to FIGS. 1 and 4, to further improve the performance of an array comprised of cBAVA elements 10, the cBAVA element 10 can be modified by adding a cross wall in the form of a metallic plate 52 and a plurality of vias to the element 10. The improved BAVA element 50, illustrated in FIG. 4, includes outer conductors 11 and 13 on respective substrates 16 and 20. The center conductor (not shown) is embedded inside the substrates 16,20 of the element 50. The BAVA element 50 additionally includes a metallic plate 52 preferably extending parallel to the H-plane of the BAVA element 50. The metallic plate 52 is located near, but spaced apart from one edge of the conductor bearing substrates 16 and 20 and from the ground plane 47. In an array of the BAVA elements, neighboring or adjacent elements are spaced apart from one another defining an air gap between adjacent elements in the manner described below with reference to FIG. 5 for a unit cell 60. The metallic cross walls 52 added in the air gaps between adjacent elements improve antenna performance, especially when scanning in the E plane. The metallic plate 52 does not contact the element 50 (or other adjacent elements in an array) either electrically or mechanically. It should be understood that the width and height of the metallic plate can vary with changes of the design parameters, antenna sizes. Moreover, if the radiating elements in this embodiment is fabricated in a contiguous substrates, the metallic cross wall can be fabricated to interlace with the substrate.

In addition, the H-plane resonance of the BAVA element 50 is removed by inserting a plurality of vias 54 that interconnect the two outer fins 11 and 13 of the BAVA element 50 (FIG. 4) in the region near the tips of the element. The vias 54 are inserted through the substrates of the BAVA element 50, with the ends of the vias being electrically connected to the two outer fins 11 and 13 of the BAVA element 50. The improved performance of the BAVA element 50 is illustrated in FIG. 3, curve 32, which is a plot of voltage standing wave ratio (VSWR) as a function of frequency for the cBAVA element 10. It is pointed out that the frequencies indicated in the frequency spectrum of the VSWR or RL plots shown in FIG. 3, as well as in the other plots shown in the drawings, are by way of non-limiting examples only and the frequencies at which the anomalies occur may be different due to different design parameters for the antenna arrays. Moreover, the concepts of the present invention can be applied over any frequency band and are not limited to frequencies less than 14 GHz, for example.

Figure 5:
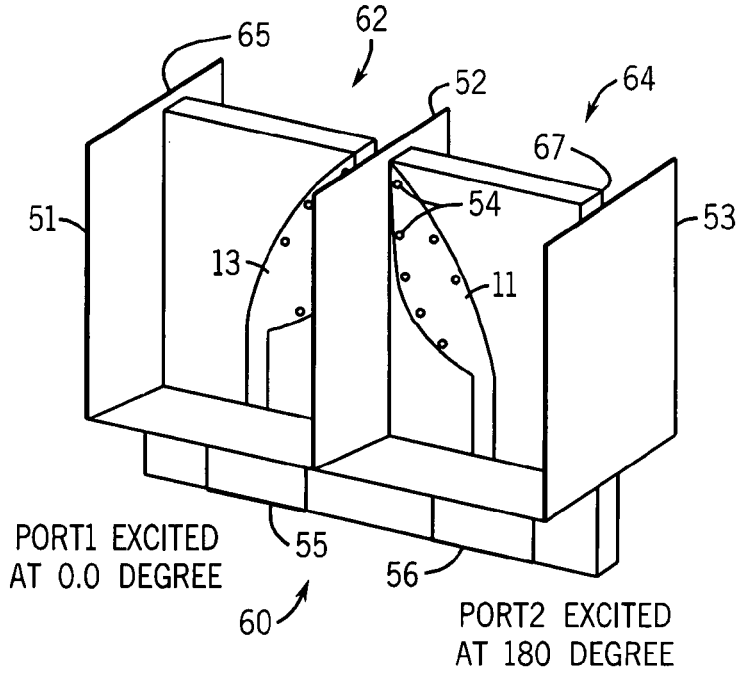
FIG. 5 is an isometric view illustrating a unit cell of an array of balanced antipodal Vivaldi antenna elements with mirroring of intermediate neighboring elements in accordance with the present invention.

FIG. 5 shows a unit cell 60 of an infinite BAVA array constructed in accordance with the present invention to have a mirrored configuration. The unit cell 60 includes elements 62 and 64 which are similar to the element 50 shown in FIG. 4 and include the outer conductors 11,13 and a center conductor (not shown), which is embedded inside the substrates of the elements 62 and 64 of the unit cell 60. The elements 62 and 64 include vias 54, interconnecting the outer conductors 11 and 13. Utilizing the image theory, the adjacent intermediate neighboring elements 62 and 64 are mirrored. Metallic cross walls 51, 52 and 53 are located in the gaps 65, 66 and 67 between adjacent elements to eliminate the first anomaly 34 (FIG. 3) as described above with reference to FIG. 4. The metallic plates 51, 52 and 53 do not contact the elements 62 and 64 (or other adjacent elements in an array) either electrically or mechanically. The metallic cross-walls can be separate plates, they can be connected to the ground plane of the array or they can be inserted from the top using the radome (not shown) that will cover the array. To maintain the radiation pattern of an array of unit cells 60, adjacent elements 62 and 64 are excited using differential excitation of the mirrored elements, via ports 55 and 56, respectively, at 0° and 180° in the E-plane direction only, resulting in parallel electric field vectors at the element apertures. Using differential excitation of the mirrored elements along the orthogonal planes of the array eliminates the second anomaly 35 (FIG. 3) from the operating band.

Introducing mirror symmetry provides good scan performance over greater than 2:1 bandwidth. Although the size of the unit cell is effectively doubled, the potential onset of the grating lobe and its associated impact on array performance seems to be well controlled by the element phasing that is applied by beam steering.

Figure 6A:
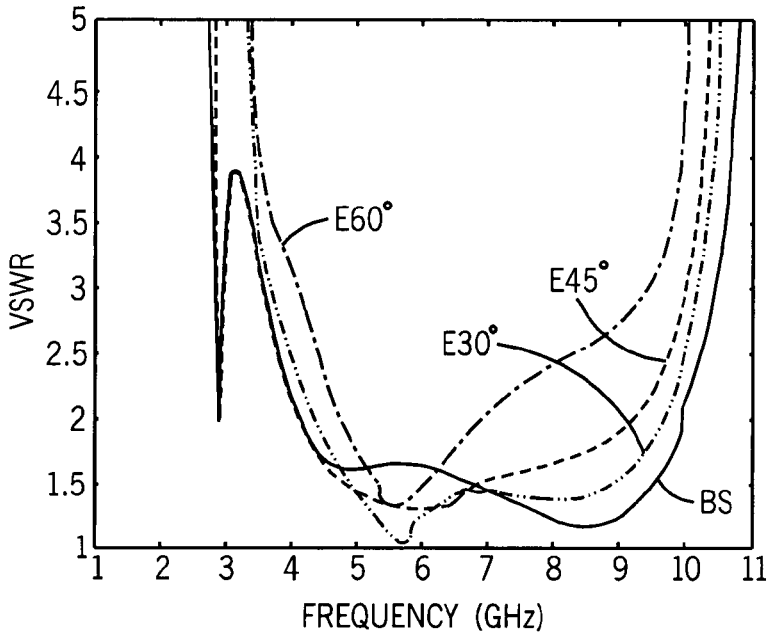
FIGS. 6A and 6B are plots of the E-plane VSWR and H-plane VSWR, respectively, as a function of frequency for the mirrored balanced antipodal Vivaldi antenna of FIG. 5.
Figure 6B:
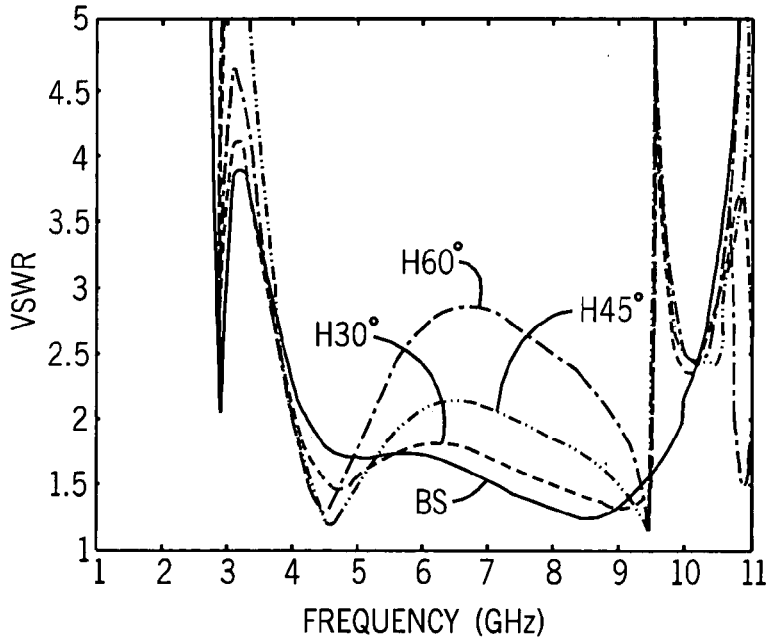

The metallic cross walls 51-53 added in the gaps between elements suppress E-plane anomalies. The vias in the substrate of the element suppress H-plane resonances. The performance of the mirrored BAVA element or unit cell 60 is illustrated in FIGS. 6A and 6B which show the effects of inserting the metallic plates 51-53 and the vias 54 to an array with a mirrored BAVA configuration realized by unit cells 60 (FIG. 5). FIG. 6A is a plot of the E-plane VSWR as a function of frequency for scan angles 30° 45° 60° in the E-plane (E30° E45° E60°) and FIG. 6B is the H-plane VSWR as a function of frequency for scan angles 30° 45° 60° in the H-plane (H30° H45° H60°). It should be understood that the array can scan in the diagonal (intercardinal) plane and in any scanning angle using the antenna's standard definition of theta (θ) and phi (ϕ). By way of a non-limiting example, the parameters of the unit cell 60 for which the results presented in FIGS. 6A and 6B were obtained, are R1=1.5, R2=−5.2, R3=−400, Cr1=0.5 cm, Cr2=1.0 cm, D=1.5 cm, A=B=1.51 cm, Ha=1.26 cm, $\in_r$=3.0, tan δ=0.003, t=90 mils, Fw=0.153 cm and G=98 mils. The parameters R1, R2, R3, Cr1, Cr2, D, A, B, Ha, $\in_r$, tan δ, t, Fw and G are those described above with respect to the cBAVA 10 and as shown in FIG. 1. Also, the mounting arrangement of the mirrored BAVA element 60 can be similar to that for the cBAVA element 10 illustrated in FIG. 1. The bandwidth of the array of unit cells 60 is impacted by a strong resonance limiting the upper frequency band to 8.4 GHz when steering the beam along the H plane, as shown in FIG. 6B. In addition, the bandwidth of the array degrades as the beam goes toward the horizon. This reduces the band of the array 2:1 for scan angles less than 45° in the H plane.

The mirrored BAVA unit cell 60, shown in FIG. 5, shows an appreciable bandwidth of 2.2:1 over a scan volume ±45. All antenna and array parameters of the antenna unit cell 10 of FIG. 1 remain fixed for the unit cell 60 shown in FIG. 5.

Figure 7A:
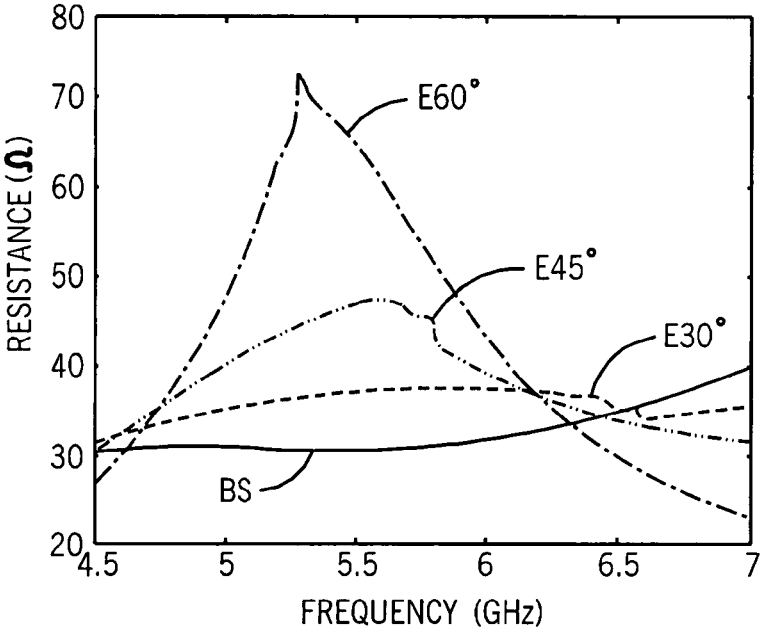
FIGS. 7A and 7B are plots of resistance and reactance, respectively, as a function of frequency, for the mirrored Balanced Antipodal Vivaldi Antenna of FIG. 5.
Figure 7B:
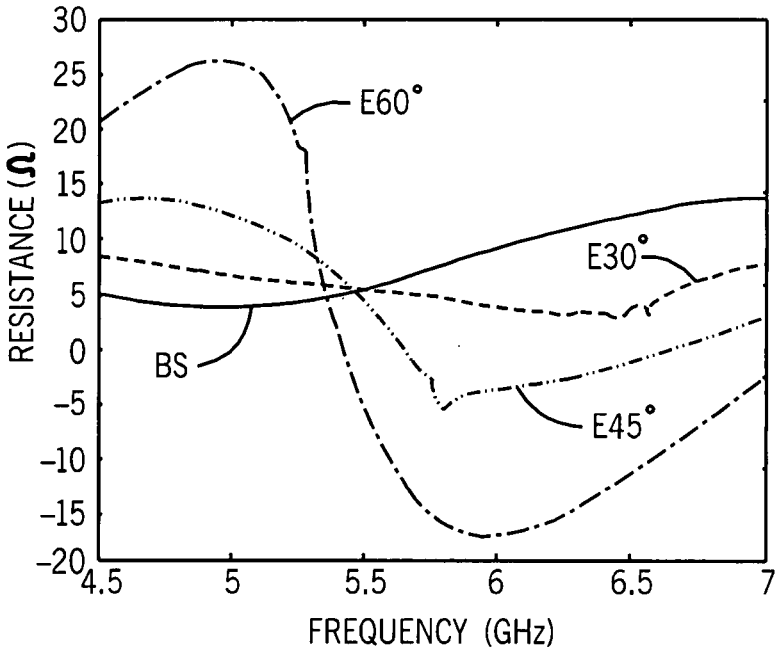

The metallic plates 51-53 weaken the anomalies seen at 6.6 GHz, 5.7 GHz and 5.25 GHz. The active input impedance of the new array configuration ripples within ±2 ohms at the anomalies as illustrated in FIGS. 7A and 7B, where FIG. 7A is a plot of resistance as a function or frequency and FIG. 7B is a plot of reactance as a function of frequency, and for the parameters of the unit cell 60 listed above.

When the beam is steered along the E plane, weak anomalies appear at approximately 6.6 GHz, 5.7 GHz and 5.25 GHz for scan angles 30°, 45° and 60°, as shown in FIG. 6B. These frequencies are slightly less than those that result in an incipient grating lobe for E-plane array spacing of 3.02 cm. FIGS. 7A and 7B show, respectively, the active resistance and reactance for 4.5-7.0 GHz. It appears that the effective unit cell size causes impedance variation in the vicinity of the grating lobe onset. It is also observed that there are strong anomalies above 7 GHz that limit the upper frequency as the beam is scanned toward the horizon along the E plane.

Referring to FIG. 8, further in accordance with the invention, it has been found that two-dimensional mirroring (i.e., mirroring along both the E-plane and the H-plane of the array) of the radiating elements of a BAVA element or unit cell eliminates the second anomaly 35 from the operating band and improves the scan-performance, resulting in a bandwidth of more than an octave.

In the doubly-mirrored array DmBAVA 70 of elements or unit cells 72, 74, 76 and 78 shown in FIG. 8, alternate elements are reversed along the E-plane, creating a mirrored symmetry to alter the mutual coupling in the array. For example, elements 72 and 74 correspond to elements 62 and 64 of the unit cell 60 shown in FIG. 5 and elements 76 and 78 are reversed with respect to elements 72 and 74. Metallic cross walls are located in the gaps between adjacent elements, such as metallic plate 75, which extends through the gap 77 between elements 72 and 74 and the gap between elements 76 and 78, for example. The metallic cross walls preferably extend parallel to the H-plane of the elements 72 and 74. The metallic cross walls, such as metallic plate 75, are neither mechanically nor electrically connected to the neighboring antenna elements. It should be understood this is not a limiting example. Also, there can be vias 79 in the DmBAVA elements 72, 74, 76 and 78.

To maintain the radiation pattern of the array, adjacent elements 72 and 74 (and elements 76 and 78) of the DmBAVA 70 are excited differential excitation of mirrored elements at 0° and 180° via ports (not shown), resulting in parallel electric field vectors at the element apertures. Using differential excitation of the mirrored elements along the orthogonal planes of the array eliminates the second anomaly from the operating band. The center-to-center spacing of the elements is maintained at 1.51 cm but the unit cell for the array is now 3.02 cm, which has an impact on grating lobe performance. Referring again to FIG. 3, curve 31 is a plot of the VSWR of the cBAVA array 10 and curve 33 is a plot of the mirrored DmBAVA array 70 with the same parameter values for the elements of the arrays. As shown, the first anomaly 34 has disappeared and the mirrored array DmBAVA 70 has a 2.4:1 bandwidth at broadside for VSWR<2:1.

Referring now to FIG. 9, there is shown a unit cell 80 of a dual-polarized (DP) array wherein orthogonal elements 92, 94, 96 and 98 are substituted for the horizontal metallic plates 77 of the unit cell 70 of the single-polarized array shown in FIG. 8 to transform the single-polarized array (SP) into a dual-polarized (DP) array. In FIG. 9, elements 82, 84, 86 and 88 of the unit cell 80 of the DP array correspond to elements 72, 74, 76 and 78 of the unit cell 70 of the doubly-mirrored SP array shown in FIG. 8. Also elements 82, 84, 86 and 88 include vias 79 (not shown in FIG. 9). The orthogonal elements 92 and 94 extend along a plane that passes through the air gap 97 between the elements 82 and 84 and between the elements 86 and 88. Similarly, the orthogonal elements 96 and 98 extend along a plane that passes through the gap 99 between the element 82 and an adjacent element (not shown) and between the element 86 and an adjacent element (not shown). The orthogonal elements are neither mechanically nor electrically connected to the neighboring antenna elements. Alternatively, the elements can be connected if it desirable by the designer. The mounting arrangement of the BAVA elements 70 and 80 of the single-polarized SP and doubly-polarized DP arrays can be similar to those defined for the cBAVA element 10 illustrated in FIG. 1.

Referring to FIG. 10, further in accordance with the invention, a further element or unit cell 100, which is similar to the cBAVA element 10 shown in FIG. 1, includes fins 101, 102, 103 each of which includes one or more magnetic slots (MAS) 104, 105 and 106 formed all the way through the fins, in the middle of each of the fins 101, 102, 103, respectively, of the element 100. In this balanced antipodal Vivaldi antenna (BAVA-MAS) element 100, the magnetic slots 104-106 are provided by selective removal of portions of the metallic fins 101-103 of the element. The magnetic slots 104-106 results in a better match to the 2:1 VSWR bandwidth. The parameters R1, R2, R3, Cr1, Cr2, D, A, B, Ha, t, and Fw, shown in FIG. 10, are those described above with respect to the cBAVA 10 and as shown in FIG. 1. Alternatively, only the outer fins 101 and 103 can include a magnetic slot or slots, or only the center conductor 102 can include a magnetic slot or slots.

Figure 11:
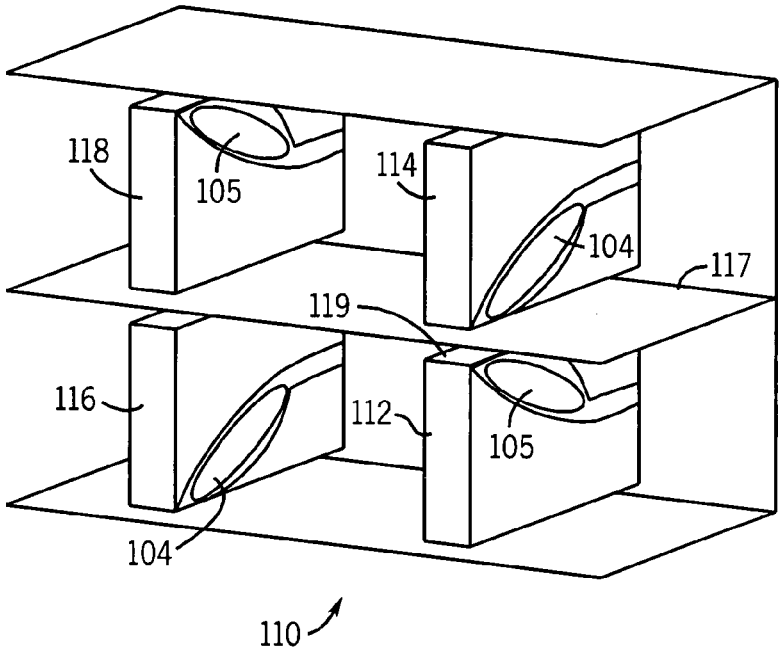
FIG. 11 an isometric view of a unit cell of a doubly-mirrored, balanced antipodal Vivaldi antenna (DmBAVA) including elements with a magnetic slot, as shown in FIG. 10, in accordance with the present invention.

Referring to FIG. 11, in accordance with the invention, a plurality of the BAVA-MAS elements 100 of FIG. 10, which include the magnetic slots 104-106, can be used in a doubly-mirrored array that includes elements similar to the elements of the doubly-mirrored doubly-mirrored array DmBAVA 70 shown in FIG. 8, providing a doubly-mirrored, balanced antipodal Vivaldi antenna with magnetic slot (DmBAVA-MAS) 110. Adding the magnetic slots 104-106 to the DmBAVA element 100 improves the VSWR impedance matching over a constant $F_H/F_L$ ratio. A unit cell of the DmBAVA-MAS is shown in FIG. 11.

In the unit cell 110 of the doubly-mirrored array DmBAVA-MAS 108, shown in FIG. 11, alternate elements are reversed along the E-plane, creating a mirrored symmetry to alter the mutual coupling in the array. For example, elements 112 and 114 correspond to elements 72 and 74 of the unit cell 60 shown in FIG. 8 and elements 116 and 118 are reversed with respect to elements 112 and 114. Metallic plates or cross walls, such as metallic plate 117, are located in the gaps between adjacent elements. For example, metallic plate 117 extends through the gap 119 between elements 112 and 114 and between elements 116 and 118, for example. The metallic cross walls or plates, such as metallic plate 75, preferably extend parallel to the H-plane of the elements 72 and 74. The metallic cross walls, such as metallic cross walls 117, are neither mechanically nor electrically connected to the neighboring antenna elements. It should be understood that this is not a limiting example, where the metallic wall can cross the substrate of the radiating elements if it seems necessary to the designer. Also, there can be vias (not shown), located in the manner of vias 79 in unit cell 70 (FIG. 8), interconnecting conductors of the elements 112, 114, 116 and 118 of the DmBAVA-MAS. The elements 112, 114, 116 and 118 of the unit cell can be inserted in stand alone fashion perpendicular to the array's back wall which acts as a ground plane 47.

To maintain the radiation pattern of the array, adjacent elements 112 and 114 (and elements 116 and 118) of the DmBAVA-MAS 108 are excited differential excitation of mirrored elements at 0° and 180° via ports (not shown), resulting in parallel electric field vectors at the element apertures. Using differential excitation of the mirrored elements along the orthogonal planes of the array substantially eliminates the second anomaly from the operating band.

Figure 12:
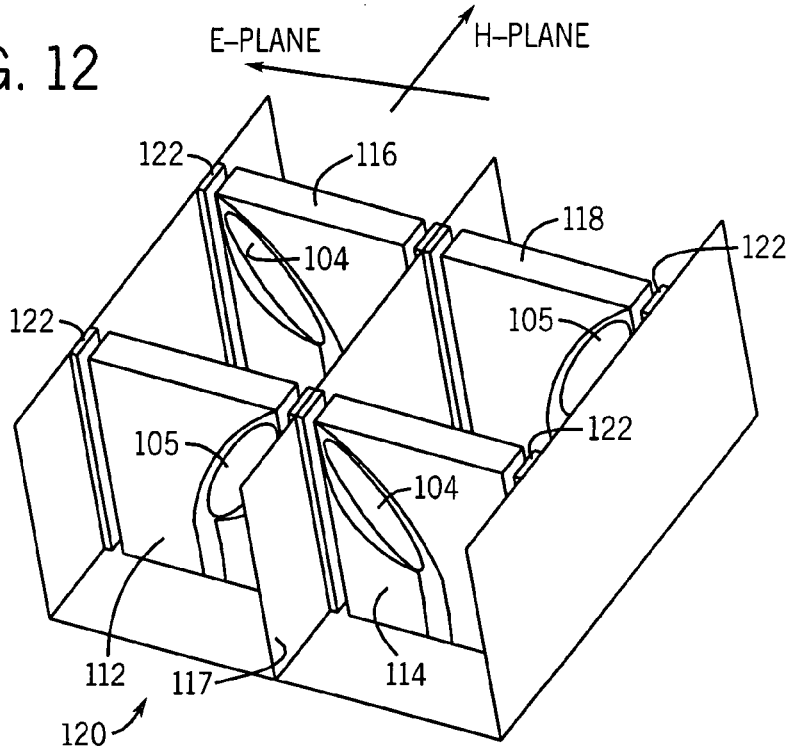
FIG. 12 is an isometric view of a unit cell of a single-polarized, doubly-mirrored array including elements with a metallic slot and including metallic rods between adjacent elements.
Figure 13:
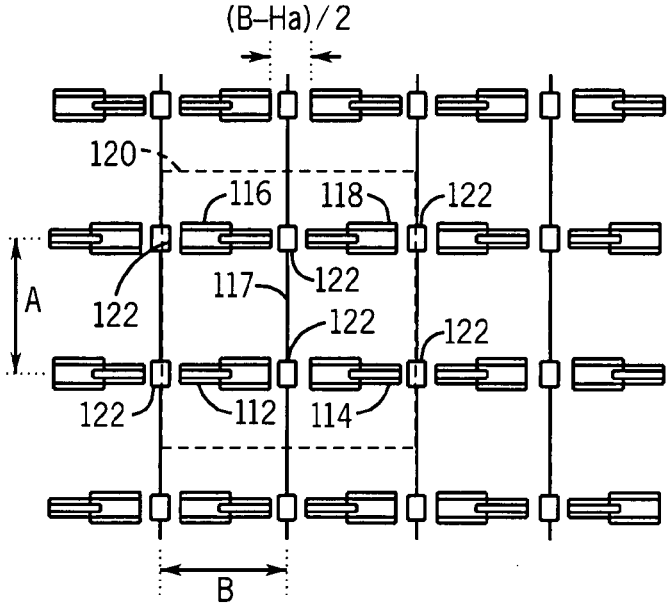
FIG. 13 is a top plan view of an infinite array of the unit cells of FIG. 12, configured as a single-polarized, doubly-mirrored balanced antipodal Vivaldi antenna, where the E field is oriented in the same direction for all of the elements in the array.

Referring to FIGS. 12 and 13, further in accordance with the invention, the array of DmBAVA-MAS elements or unit cells 110 with magnetic slots 104-106, can be further modified to include metallic rods or poles 122 which are inserted between the elements, providing an improved unit cell 120. The metallic rods 122 broaden the antenna bandwidth. The metallic rods push the lowest frequency cut-off downwards widening the operating band. The addition of the metallic rods 122 increases the operational bandwidth by moving the low-frequency cut-off down. The unit cell 120 includes the metallic plates 117 added in the gaps between adjacent elements suppress E-plane anomalies and vias (not shown) in the substrate of the element suppress H-plane resonances. The metallic plates, such as metallic plate 75, preferably extend parallel to the H-plane of the elements 72 and 74. The metallic plates are neither mechanically nor electrically connected to the neighboring antenna elements. However, the metallic cross walls can contact the metallic rods, electrically and/or mechanically, as shown in FIG. 13, for example. The metallic plates, or cross walls, improve the scan-bandwidth by maintaining a 2:1 VSWR at large scan-angle.

FIG. 13 is a top plan view of a portion of the infinite array 121 where the E-field is oriented in the same direction for all elements in the array. As can be seen, the metallic rods 122 are neither mechanically nor electrically connected to the neighboring antenna elements 120. For example, However, the metallic poles and the outer conductors of the antenna elements are terminated at a common ground plane 47 in the back of the array.

As stated above with respect to the unit cell 120, the two-dimensional mirroring (i.e., mirroring along both the E-plane and the H-plane of the array) of the radiating elements of a BAVA eliminates the second anomaly 35 (FIG. 3) from the operating band and improves the scan-performance, resulting in a bandwidth of more than an octave.

Figure 14:
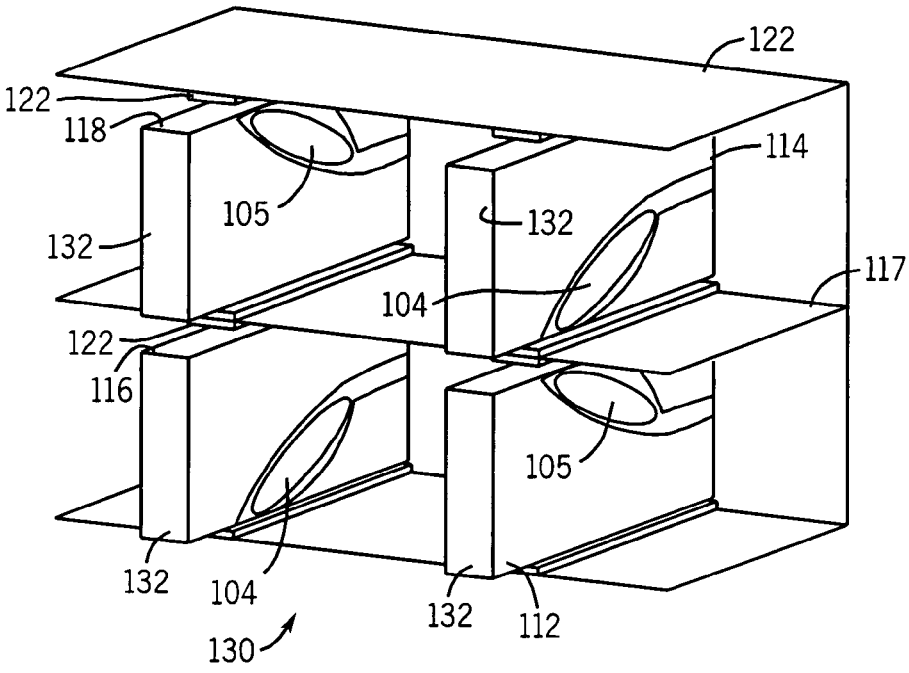
FIG. 14 an isometric view of a unit cell of a doubly-mirrored, balanced antipodal Vivaldi antenna including elements with a magnetic slot, and including metallic rods and a dielectric slab at the aperture of the element in accordance with the present invention.

Referring to FIG. 14, in accordance with the invention, the unit cell 120 of the DmBAVA-MAS shown in FIGS. 12 and 13 can be modified to include dielectric material 132 located at the aperture of the DmBAVA element, improving the VSWR impedance matching. By way of a non-limiting example, the dielectric material 132 can be an extension of the substrate. Alternatively, the dielectric can be a slab of dielectric material that is separate from the substrate. Although adding the dielectric material 132 increases the length of the antenna element, and thus, the overall length of the antenna array, the presence of the dielectric material improves the impedance matching in the operational bandwidth.

FIG. 15 is a plot of the VSWR as a function of frequency for the doubly-mirrored, DmBAVA-MAS element with the dielectric slab (curve 152), the DmBAVA-MAS element without the dielectric slab (curve 154) and the conventional cBAVA element (curve 156).

Figure 16:
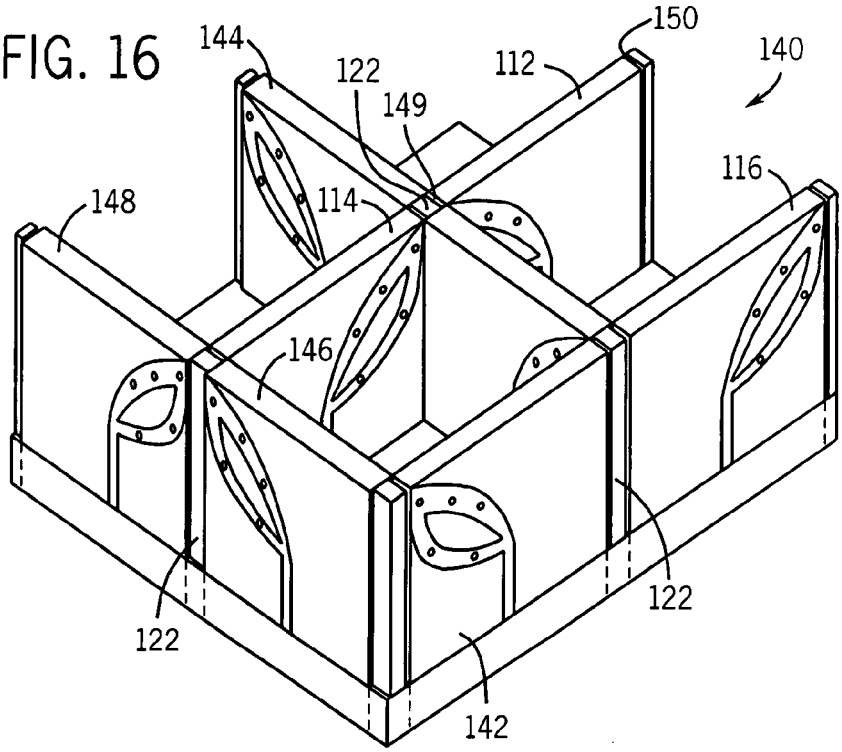
FIGS. 16 and 17 show the transformation of the single-polarized, doubly-mirrored array of FIGS. 10-14 into a doubly-polarized, doubly-mirrored array.

Referring to FIGS. 11 and 16, the antenna array FIG. 11, which is implemented as a single-polarized (SP) array, can also be implemented as a dual-polarized (DP) array. In a single-polarized (SP) array, such as the SP array shown in FIG. 11, metallic plates parallel to the H plane of the array are inserted in gaps between adjacent elements to improve the E-plane scan performance. It is worth to be noted that it is an optional feature of the present invention that the mirroring technique is not required to obtain a performance similar to that for the cBAVA array. This can be realized by inserting metallic cross walls along the H-plane of the cBAVA array without any mirroring to the elements in the array.

Figure 17:
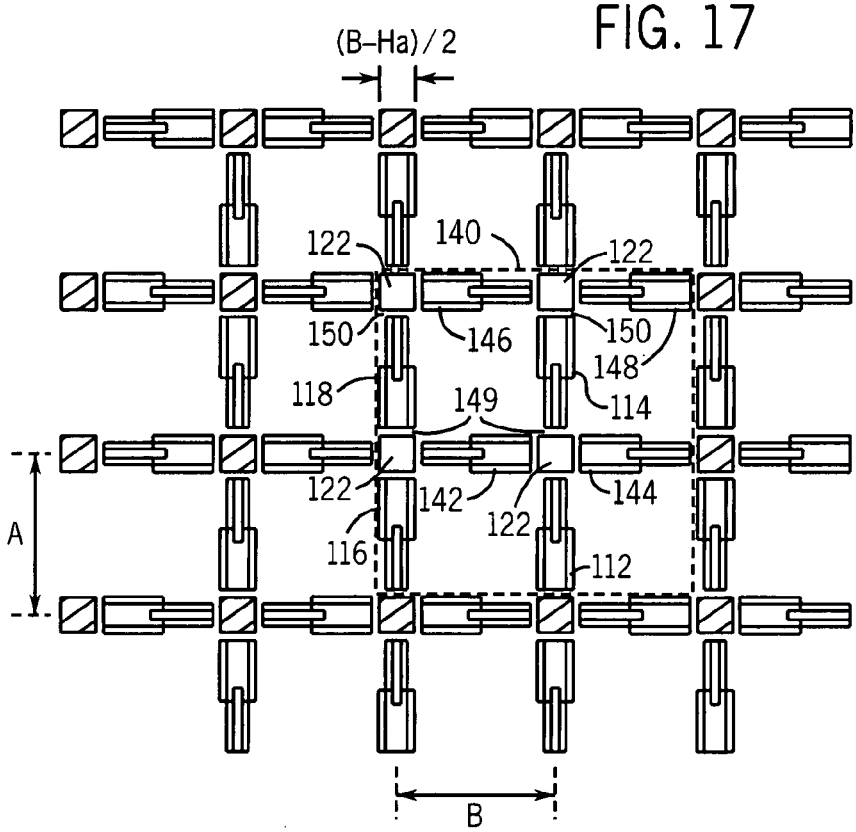

FIGS. 16 and 17 show the transformation of the single-polarized, doubly-mirrored array 110 of FIG. 11 into a doubly-polarized, doubly-mirrored array (DP) DmBAVA-MAS 140. FIG. 16 is an isometric view of the (DP) DmBAVA-MAS 140 and FIG. 17, is a top plan view of the (DP) DmBAVA-MAS 140. The unit cell 140 is periodic and can slide anywhere in the array. FIG. 16 is the same as in FIG. 17, but viewing the unit cell from a different angle. Referring to FIGS. 16 and 17, in the unit cell 140 of the (DP) DmBAVA-MAS, orthogonal elements 142, 144, 146 and 148 are substituted for the horizontal metallic plates 117 of the unit cell 110 of the single-polarized array shown in FIG. 11 to transform the single-polarized array (SP) into a dual-polarized (DP) array. In FIG. 16, elements 112, 114, 116 and 118 of the unit cell 110 of the (DP) DmBAVA-MAS array 140 are the like-numbered elements 112, 114, 116 and 118 of the unit cell 110 of the doubly-mirrored SP array shown in FIG. 11. The orthogonal elements 142 and 144 extend along a plane that passes through the gap 149 between the elements 112 and 114 and between the elements 116 and 118. Similarly, the orthogonal elements 146 and 148 extend along a plane that passes through the gap 150 between the element 114 and an adjacent element (not shown) and between the element 118 and an adjacent element (not shown). The orthogonal elements are neither mechanically nor electrically connected to the neighboring antenna elements as can be seen in FIG. 17, for example. The (DP) DmBAVA-MAS array 140 includes metallic rods or poles 122 which are inserted between the elements as shown in FIG. 12 for the array of DmBAVA-MAS elements or unit cells 110.

In a dual-polarized (DP) array, the metallic plates are not necessary. The addition of orthogonal elements 142-148 to create a DP version of an SP array causes the orthogonal antennas to produce similar effects to the metallic cross walls. FIG. 18 is a plot of the VSWR as a function of frequency for the dual-polarized (DP) array of FIGS. 16 and 17.

Figure 19:
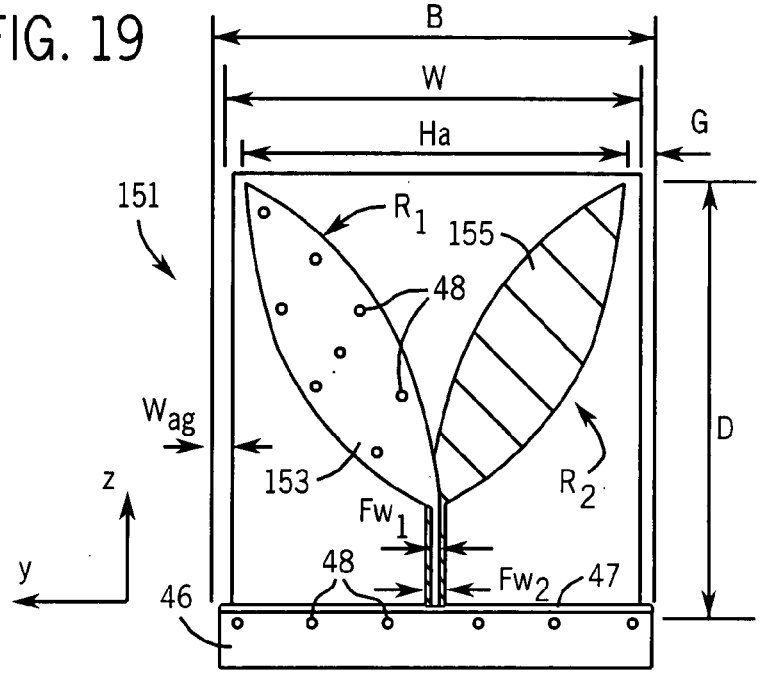
FIG. 19 illustrates an alternative structure of a balanced antipodal Vivaldi antenna element and unit cell, where the width of the triline feed section on the upper and bottom conductor is different than that in the center conductor in accordance with the present invention.

In accordance with an embellishment, the widths of the conductors of the antenna element 151 can be different. FIG. 19 illustrates an alternative structure of a balanced antipodal Vivaldi antenna element and unit cell in accordance with the present invention. The antenna element 151 is somewhat similar to the antenna element 36 shown in FIG. 2, and includes vias 48, triline 46 and a ground plane 47. The triline 46 can include vias 48. The substrates on which conductors 153 and 155 are formed are shorter than the triline 46 by an amount equal to dimension $W_{ag}$. Another improvement to the design is to consider removing dielectric material from the bottom of the element. This doesn't impact the scan-performance but could lighten the weight of the array The upper and bottom conductors, such as conductor 153, and the embedded conductor 155 have different configurations and accordingly have been given different reference numbers from those of the conductors of the antenna element 36 of FIG. 2. In the unit cell, the widths $F_{w1}$ of the upper and bottom conductors (such as conductor 153) of the triline section are made different from the width $F_{w2}$ of the embedded conductor 155. Preferably, the upper and bottom conductors have the same widths $F_{w1}$.

Figure 20A:
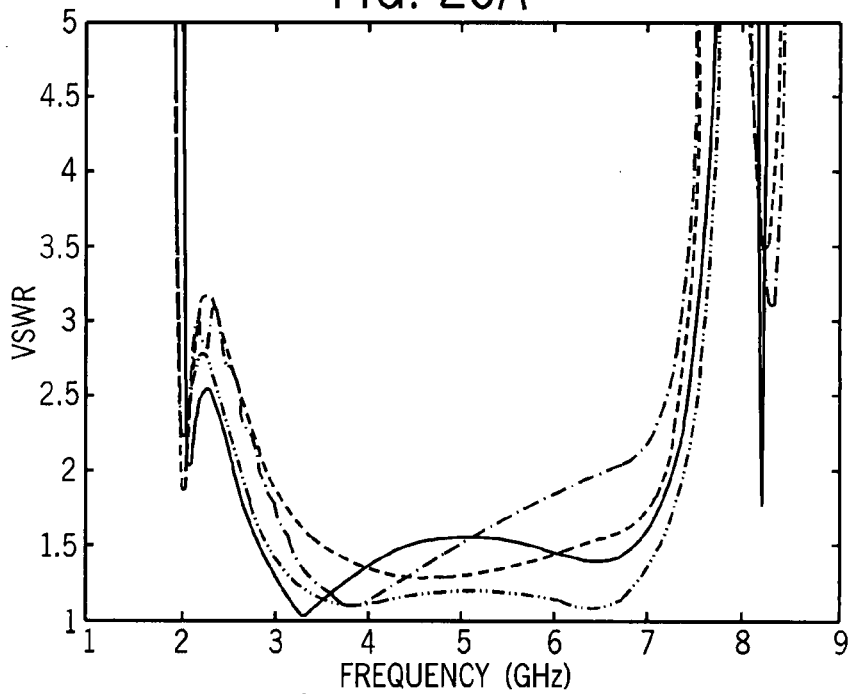
FIGS. 20A and 20B are plots of the E-plane VSWR and H-plane VSWR as a function of frequency for different conductor widths for the conductors of the triline section for the balanced antipodal Vivaldi antenna of FIG. 19.
Figure 20B:
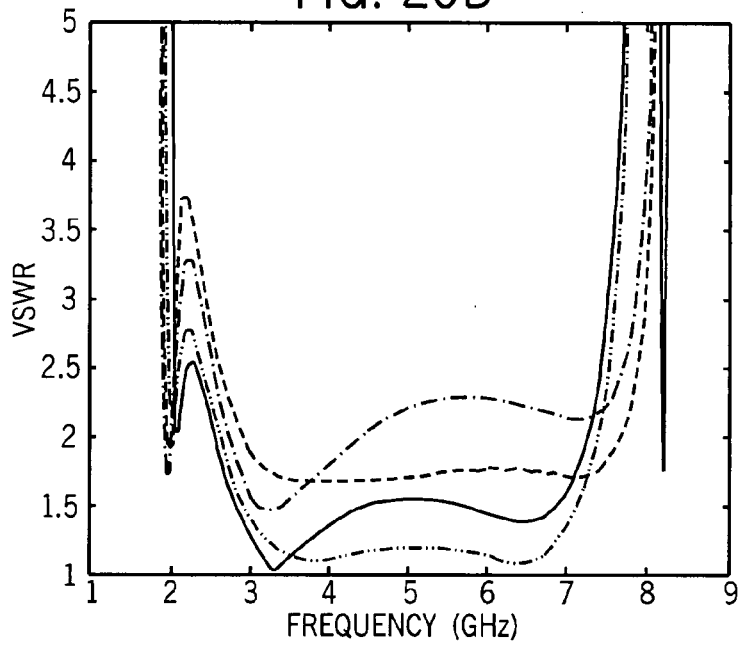

FIGS. 20A and 20B are plots of the E-plane VSWR and H-plane VSWR, respectively, as a function of frequency for different conductor widths for the conductors 153 and 155, for example of the triline section for the balanced antipodal Vivaldi antenna of FIG. 19. When $F_{w1}<F_{w2}$, the impedance match is significantly improved over wide-scan angle as is depicted in FIGS. 20A and 20B.

Figure 21:
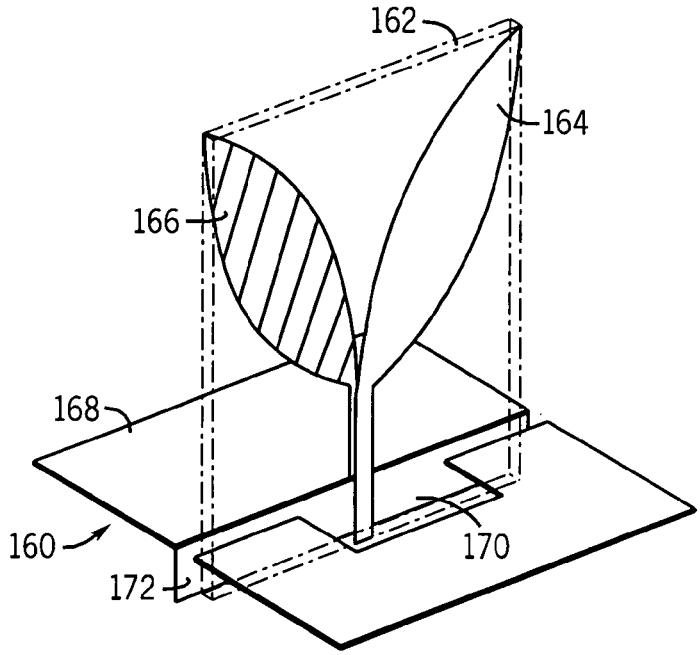
FIG. 21, which is labeled "Prior Art", is an isometric view illustrating a conventional antipodal Vivaldi antenna (AVA)

Referring to FIG. 21, there is shown a simplified representation of an element or unit cell 160 of a conventional planar array of an Antipodal Vivaldi Antenna (AVA). The unit cell 160 is corresponds to that reported by E. Gazit, in a paper entitled "Improved Design of the Vivaldi Antenna," IEE Proceedings, Vol. 135, No. 2 Apr. 1998. pp. 89-92. The unit cell 160 includes a conductor bearing substrate 162 with a metallic fin 164 on the upper surface of the substrate and a metallic fin 166 on the lower surface of the substrate. The conductors terminate in a ground plane 168 for the array with clearance, indicated generally at 170 to allow formation of a fringing of a microstripline 172 that feeds the antenna.

Figure 22:
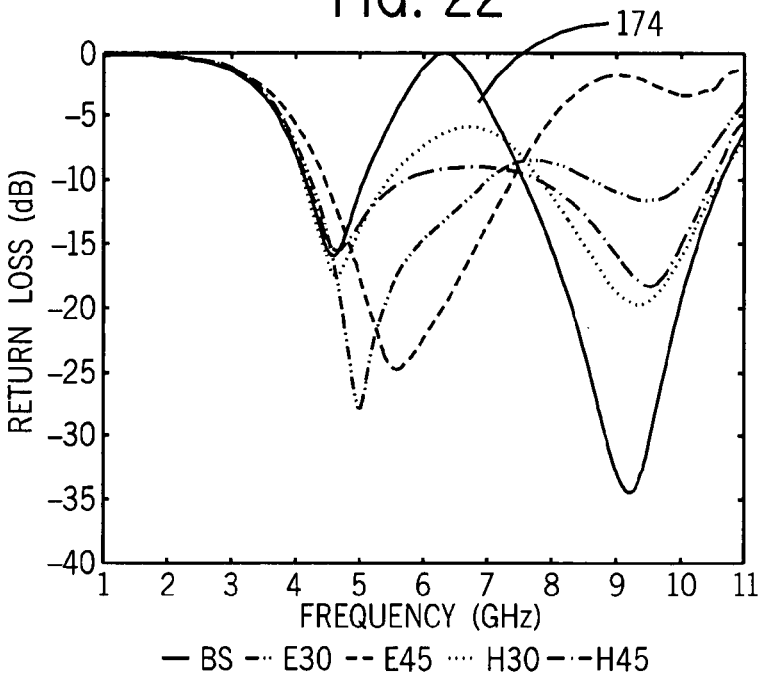
FIG. 22 is a plot of return loss as a function of frequency for different scan angles for the antipodal Vivaldi antenna of FIG. 21.

FIG. 22 illustrates the return loss for the AVA 160 of FIG. 21. FIG. 22 is a plot of return loss as a function of frequency for broadside (BS), in the E-plane a scan angle of 30° (E30), in the E-plane at a scan angle of 45° (E45), in the H-plane at a scan angle of 30° (H30) and in the H-plane at a scan angle of 45° (H45) for the unit cell 160. It has been found that a planar array of the AVA has an anomaly 174 (FIG. 22) in the middle of the desired operational band (<10 GHz). That anomaly begins to diminish as the array is scanned in the E or H planes, as is depicted in FIG. 22.

Figure 23:
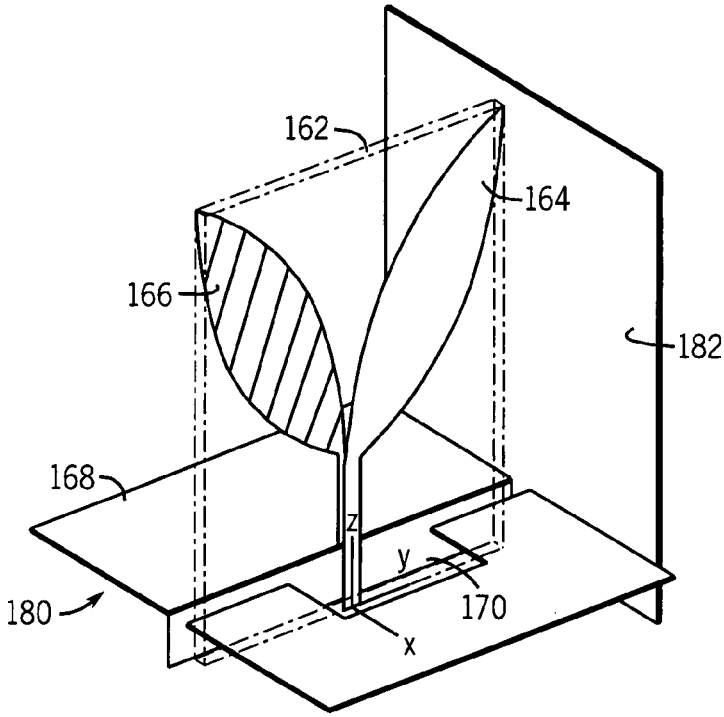
FIG. 23 is an isometric view illustrating an antipodal Vivaldi antenna (AVA) including metallic cross walls in accordance with the present invention.

FIG. 23 is a simplified representation of a unit cell 180 of an AVA array which is similar to the unit cell 160 of FIG. 21 and accordingly, like components have been given the same reference numbers in FIGS. 21 and 23. The unit cell 180 also includes metallic cross walls, such as metallic cross wall 182, inserted in the air gap between the element 180 and an adjacent element (not shown) in the AVA array, in the manner of the element 50 shown in FIG. 4.

Figure 24:
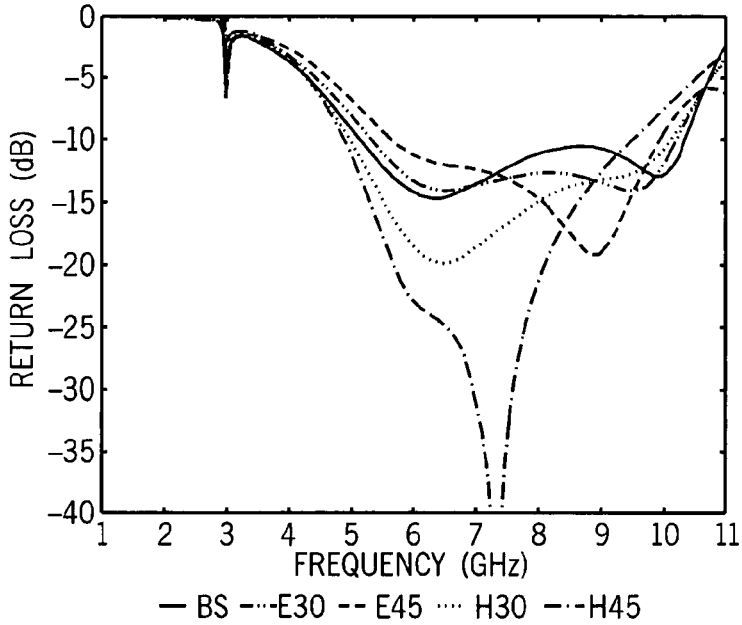
FIG. 24 is a plot of return loss as a function of frequency for different scan angles for the antipodal Vivaldi antenna of FIG. 23.

FIG. 24 illustrates the return loss for the planar AVA array formed from a plurality of the unit cells, such as unit cell 180 shown in FIG. 23, that have metallic cross walls. FIG. 24 is a plot of return loss as a function of frequency for broadside (BS), in the E-plane a scan angle of 30° (E30), in the E-plane at a scan angle of 45° (E45), in the H-plane at a scan angle of 30° (H30) and in the H-plane at a scan angle of 45° (H45) for the array of the unit cells 190. The planar array has a 2:1 bandwidth over a wide-scan angle.

Figure 25:
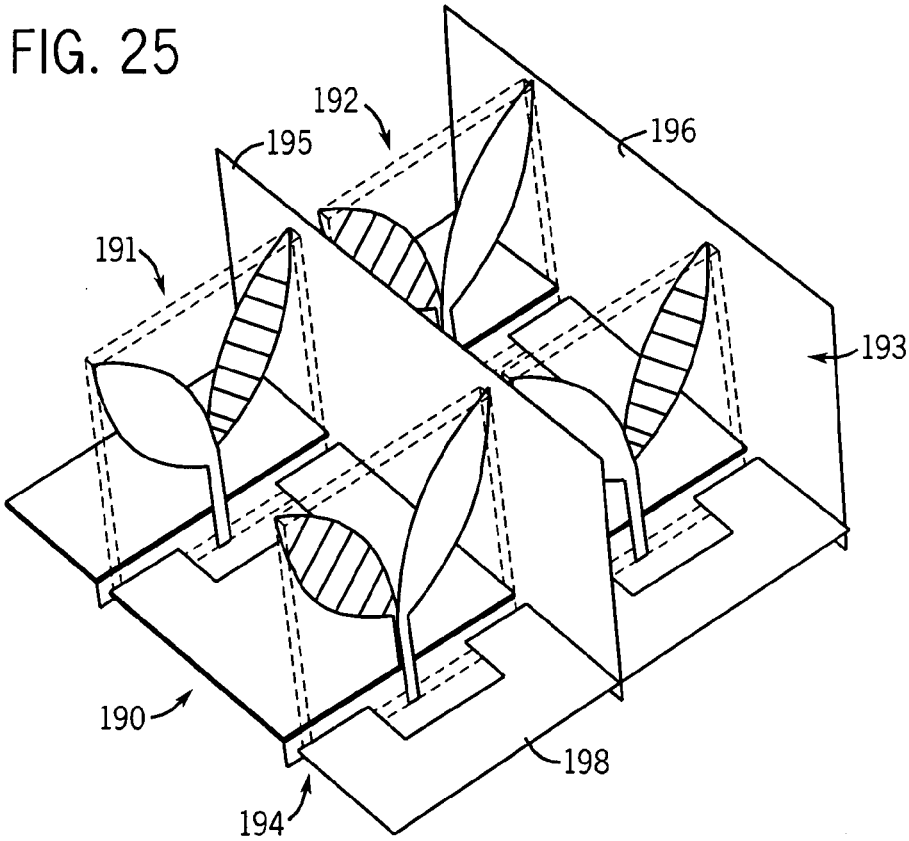
FIG. 25 is an isometric view illustrating a doubly mirrored, antipodal Vivaldi antenna (AVA) including metallic cross walls in accordance with the present invention.
Figure 26:
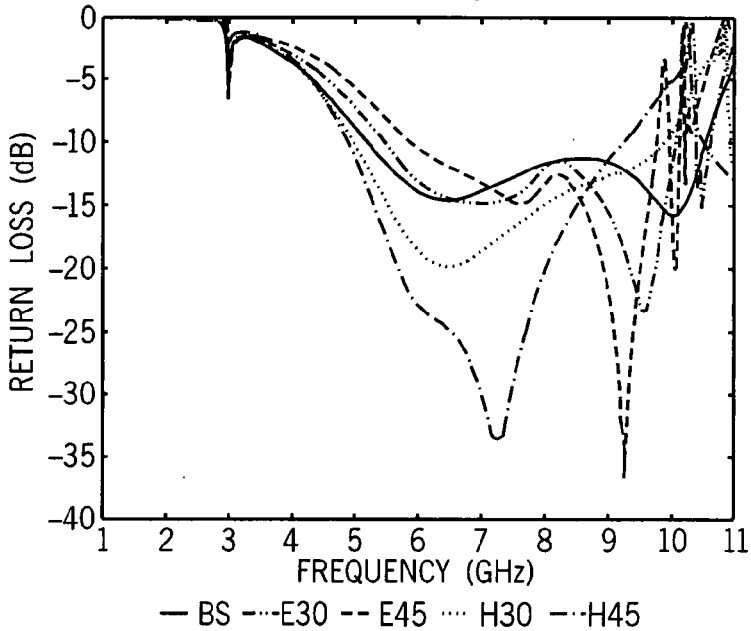
FIG. 26 is a plot of return loss as a function of frequency for different scan angles for the antipodal Vivaldi antenna of FIG. 25.

Similarly, if a doubly-mirrored configuration is applied to a planar array of AVA, the doubly-mirrored array has a improved performance. FIG. 25 is a simplified representation of a doubly mirrored AVA unit cell 190 of a planar array including four elements 191-194 with metallic cross walls, such as cross walls 195 and 196, located in the air gaps 198 between adjacent elements of the unit cell, in the manner of the doubly-mirrored array 70 shown in FIG. 8. FIG. 26 illustrates the return loss for the doubly mirrored planar array AVA of the unit cells 190 with metallic cross walls shown in FIG. 25, with the plots indicated using the convention used in FIG. 22. FIG. 26 is a plot of return loss as a function of frequency for scan angles BS, E30, E45, H30 and H45 for the array of the unit cells 190. As shown, the array has a better impedance match in the E-plane scan and a slightly more bandwidth in the H-plane scan.

In addition, it is expected that adding a magnetic slot (not shown) to each element of the array formed by a plurality of unit cells 190 in the manner described above with reference to FIG. 10, for example, and adding metallic rods to the array in the manner described above with reference to FIG. 12, for example, will improve the performance in the AVA, like in the manner the performance of the BAVA was improved.

Figure 27:
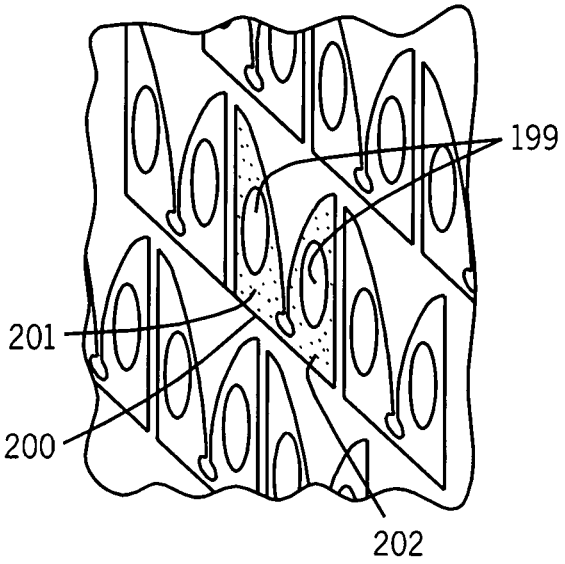
FIG. 27 is a simplified representation of a portion of an array of disconnected Vivaldi antenna elements including magnetic slots and vias in accordance with the present invention.

Referring to FIG. 27, adding magnetic slots and metallic rods to an antenna that is comprised of disconnected Vivaldi elements, such as elements, improves the impedance match and widens the operating frequency band. A simplified representation of a portion of a disconnected Vivaldi antenna 198 with the magnetic slots 199 in each of the fins 201 and 202 of the elements 200 is shown in FIG. 26. The disconnected Vivaldi has a feed line (either stripline or microstrip) and vias not shown in FIG. 27. In addition, metallic rods can be added to the array in the manner described above with reference to FIGS. 12 and 13. The configuration and effects of the metallic rod and magnetic slot in the disconnected Vivaldi are similar to those described above with reference to the DmBAVA-MAS unit-cell shown in FIGS. 10, 12 and 13, for example.

Although all of the above techniques are demonstrated for a single-polarized embodiment, the techniques can be extended into a doubly-polarized array, such as the doubly-polarized array shown in FIG. 16.

Although the invention has been described with reference to application in a Balanced Antipodal Vivaldi Antenna (BAVA), many of the concepts described above are not limited to Balanced Antipodal Vivaldi Antenna (BAVA). and can be applied to any antenna that has the nature of being antipodal symmetry. Examples of concepts that can be applied to antennas other than Balanced Antipodal Vivaldi Antenna include one-dimensional mirroring as illustrated in FIG. 5, doubly-mirroring as illustrated in FIG. 8, the use of a magnetic slot as illustrated in FIG. 10, the insertion of metallic rods as illustrated in FIG. 12, the use of metallic cross walls, as illustrated in FIGS. 21, 23 and 25, the addition of magnetic slots to elements of a disconnected Vivaldi antenna as shown in FIG. 26, and combinations of any of the above features in a single or a dual polarized array.

Thus, the modifications of the conventional cBAVA in accordance with the present invention, result in an antenna array having a more than one octave bandwidth. Adding metallic cross walls to the cBAVA eliminates the first anomaly. Applying the doubly mirroring technique to the cBAVA with metallic cross walls broadens the bandwidth. Significant bandwidth enhancement is noticed in a dual polarized array. A single polarized array without metallic cross walls, but utilizing a doubly mirrored configuration, works broadside and along the H-plan scan only. The array can be fabricated by adding metallic cross walls to a conventional cBAVA. Another improvement to the design is to remove the dielectric material from the bottom of the element. Although this may not impact the scan-performance of an array of such elements, it would decrease the weight of the array. Alternatively, the array can be fabricated using a doubly mirrored technique with metallic cross walls. In any of the above arrangements, the array can be fabricated based on the use of modular elements (without electrical or mechanical contact) and/or can be fabricated with elements printed on contiguous dielectric substrate but with no electrical contact. Further modifications can include adding a metallic slot to the elements, which improves the VSWR impedance matching over constant $F_H/F_L$ ratio, adding metallic rods between the elements, which broadens the antenna bandwidth because it pushes the low frequency down, and adding a dielectric slab located at the aperture of the elements, which improves the VSWR impedance matching. Moreover, as is described above, a single polarized array can be easily transformed into a dual polarized array. The invention can be realized in an isolated element, a unit cell and a plurality of unit cells. By way of example, an isolated element can be defined as a single antenna. i.e. not in an array, and with no neighboring elements. A unit-cell can defined as a collection of single elements organized in a matter (whether there is a mirroring or not) that periodicity occurs. An antenna array can be defined as a plurality of unit cells that are organized to realize a linear (1-dimensional) array, a planar (2 dimensional) array or a conformal (3 dimensional) array. The antenna elements and/or antenna unit cells disclosed herein can be manufactured individually and assembled into an array, or a plurality of antennas can be manufactured on a single substrate and, if desired, multiple substrates can be combined into an array.

Although an exemplary embodiment of the present invention has been shown and described with reference to particular embodiments and applications thereof, it will be apparent to those having ordinary skill in the art that a number of changes, modifications, or alterations to the invention as described herein may be made, none of which depart from the spirit or scope of the present invention.

For example, the air gaps mentioned in all the previous embodiments between adjoining elements can be filled with dielectric materials. Moreover, all of the elements in the same row can be printed on the same card, or a group of N×1 element can be printed on a card. The latter realizes a modular subarray concept.

What is claimed is:

1. A balanced antipodal tapered slot antenna comprising:

a plurality of unit cells arranged in an antenna array, each of said unit cells including at least one antenna element, said antenna element including first and second substrates of a dielectric material; and first, second and third metallic conductors, said first and third conductors being disposed on said first and second substrates, defining a balanced ground plane for said antenna element in a feed region for said antenna element, said second metallic conductor disposed on one of said substrates defining a transmission line in the feed region of said antenna element, wherein substrates and conductors of said elements have a mirrored orientation at least one-dimensionally, said first, second and third metallic conductors having minor image symmetry with respective first, second and third metallic conductors of adjacent antenna elements; and at least one metallic cross wall located between said one antenna element and a further antenna element of said antenna array that is located adjacent said one antenna element; and a feed line coupled to said transmission line for applying excitation signals to said antenna array from driving circuitry.

2. The balanced antipodal tapered slot antenna according to claim 1, wherein said metallic cross wall is located in an air gap between said adjacent antenna elements, disposed at least in a non-electrically contacting relationship with said adjacent antenna elements.

3. The balanced antipodal tapered slot antenna according to claim 1, wherein at least said first and third conductors each include one or more magnetic slots.

4. The balanced antipodal tapered slot antenna according to claim 1, wherein at least said second conductor includes one or more magnetic slots.

5. The balanced antipodal tapered slot antenna according to claim 1, wherein each unit cell includes a metallic rod that is located between adjacent said antenna elements of said unit cell, said metallic rod disposed at least in a non-electrically contacting relationship with said adjacent antenna elements.

6. The antenna element or unit cell according to claim 1, including dielectric material located at an aperture of the antenna element, wherein said dielectric material is an extension of one or more of said substrates or a slab of dielectric material that is separate from said substrates.

7. The antipodal tapered slot antenna according to claim 1, wherein said first and second conductors each include one or more magnetic slots.

8. A balanced antipodal tapered slot antenna comprising:

a plurality of unit cells arranged in an antenna array, each of said unit cells including at least one antenna element, said antenna element including first and second substrates of a dielectric material; and first, second and third metallic conductors, said first and third conductors being disposed on said first and second substrates, defining a balanced ground plane for said antenna element in a feed region for said antenna element, said second metallic conductor disposed on one of said substrates defining a transmission line in the feed region of said antenna element, wherein said substrates and conductors of said elements of said antenna array have a mirrored orientation at least one-dimensionally, said first, second a third metallic conductors having mirror image symmetry with respective first, second and third metallic conductors of adjacent antenna elements, and a feed line coupled to said transmission line for applying excitation signals to said antenna array from driving circuitry.

9. The balanced antipodal tapered slot antenna according to claim 8, wherein said antenna array is doubly-mirrored, two-dimensionally, in the E-plane and the H-plane by reversing the orientation of alternate elements along the E-plane and the H-plane.

10. The balanced antipodal tapered slot antenna according to claim 9, wherein said doubly-mirrored antenna array is a single-polarized array.

11. The balanced antipodal tapered slot antenna according to claim 9, wherein said doubly-mirrored antenna array is a dual-polarized array.

12. The antipodal tapered slot antenna according to claim 7, wherein said first and second conductors each include one or more magnetic slots.

13. An antipodal tapered slot antenna comprising:

a plurality of unit cells arranged in an antenna array, each of said unit cells including at least one antenna element, said antenna element including a first substrate of a dielectric material having first and second sides, a first metallic conductor on said first side of said substrate defining a ground conductor for said antenna in a feed region of said antenna element, a second metallic conductor on said second side of said substrate; and at least one metallic cross wall located in an air gap between said one antenna element and a further antenna element of said antenna array located adjacent said one antenna element, wherein said metallic cross wall is disposed in a non-electrically contacting relationship with said antenna elements; and a feed line coupled to said second metallic conductor for applying excitation signals to said antenna array from driving circuitry.

14. The antipodal tapered slot antenna according to claim 13, wherein said first and second conductors each include one or more magnetic slots.

15. The antipodal tapered slot antenna according to claim 13, wherein said unit cell includes at least one metallic rod located between said adjacent antenna elements.

16. A antipodal tapered slot antenna comprising:

a plurality of unit cells arranged in an antenna array, each of said unit cells including at least one antenna element, said antenna element including a first substrate of a dielectric material having first and second sides, a first metallic conductor on said first side of said substrate, a second metallic conductor on said second side of said substrate; and at least one metallic cross wall between said antenna elements, wherein said metallic cross wall is disposed in an air gap in a non-electrically contacting relationship between said antenna elements, and wherein elements of said array are mirrored one-dimensionally, whereby adjacent antenna elements have mirror image symmetry; and a feed line coupled to said second metallic conductor for applying excitation signals to said antenna array from driving circuitry.

17. The antipodal tapered slot antenna according to claim 16, wherein said excitation signals comprise first and second excitation signals that are out of phase and are applied to said adjacent antenna elements via first and second excitation signal ports of said antenna array, providing differential excitation for said adjacent antenna elements.

18. The antipodal tapered slot antenna according to claim 16, wherein said antenna array is doubly-mirrored, two-dimensionally, in the E-plane and the H-plane.

19. The antipodal tapered slot antenna according to claim 18, wherein said doubly-mirrored antenna array is a single-polarized antenna array.

20. The antipodal tapered slot antenna according to claim 16, wherein a first plurality of antenna elements of said antenna array are disposed orthogonally with respect to a second plurality of antenna elements of said antenna array.

21. The antipodal tapered slot antenna according to claim 18, wherein said doubly-mirrored antenna array is a dual-polarized antenna array.

22. An antipodal tapered slot antenna comprising:

a plurality of unit cells arranged in an antenna array, each of said unit cells including at least one antenna element, said antenna element including a first substrate of a dielectric material having first and second sides;

a first metallic conductor on said first side of said substrate;

a second metallic conductor on said second side of said substrate;

a feed line coupled to second metallic conductor for applying excitation signals to said antenna array from driving circuitry; and a metallic cross wall located in an air gap between said one antenna element and a further antenna element of said antenna array and disposed in a non-electrically contacting relationship with said antenna elements.

23. The antenna element or unit cell according to claim 22, wherein each of said first, and second conductors includes one or more magnetic slots.

24. The antenna element or unit cell according to claim 22, including dielectric material located at the aperture of the antenna element, wherein said dielectric material is an extension of one or more of said substrates or a slab of dielectric material that is separate from said substrates.

25. An antipodal tapered slot antenna comprising:

a plurality of unit cells arranged in an antenna array, each of said unit cells comprising at least one antenna element, said antenna element comprising a first substrate of a dielectric material having first and second sides, a first metallic conductor on said first side of said substrate, a second metallic conductor on said second side of said substrate;

at least one metallic cross wall located between said one antenna element and a further antenna element of said antenna array located adjacent said one antenna element, said metallic cross wall being located in an air gap between said antenna elements and disposed in a non-electrically contacting relationship with said antenna elements; and a feed line coupled to a tapered transmission line for applying excitation signals to said antenna array from driving circuitry.

26. The antipodal tapered slot antenna according to claim 25, wherein said first, and second conductors each include one or more magnetic slots.

27. The antipodal tapered slot antenna according to claim 25, wherein said unit cell includes at least one metallic rod located between said adjacent antenna elements.

* * * * *

UNITED STATES PATENT AND TRADEMARK OFFICE

CERTIFICATE OF CORRECTION

PATENT NO. : 8,466,845 B2
APPLICATION NO. : 11/899920
DATED : June 18, 2013
INVENTOR(S) : Mohd Wajih A. Elsallal et al.

It is certified that error appears in the above-identified patent and that said Letters Patent is hereby corrected as shown below:

In the Claims:

At column 18, claim number 1, line number 7, “minor” should read <mirror>.

Signed and Sealed this
Seventeenth Day of September, 2013

Teresa Stanek Rea
*Deputy Director of the United States Patent and Trademark Office*